US010117511B2

(12) United States Patent
Gosling et al.

(10) Patent No.: US 10,117,511 B2
(45) Date of Patent: Nov. 6, 2018

(54) MODULAR FURNITURE SYSTEM WITH WIRE MANAGEMENT

(71) Applicant: DIRTT ENVIRONMENTAL SOLUTIONS, INC., Salt Lake City, UT (US)

(72) Inventors: Geoff Gosling, Calgary (CA); Mogens F. Smed, DeWinton (CA); Thomas A. Brown, Calgary (CA)

(73) Assignee: DIRTT ENVIRONMENTAL SOLUTIONS, LTD, Calgary (CA)

( * ) Notice: Subject to any disclaimer, the term of this patent is extended or adjusted under 35 U.S.C. 154(b) by 0 days.

(21) Appl. No.: 15/122,370

(22) PCT Filed: Jun. 15, 2016

(86) PCT No.: PCT/US2016/037691

§ 371 (c)(1),
(2) Date: Aug. 29, 2016

(87) PCT Pub. No.: WO2016/205413

PCT Pub. Date: Dec. 22, 2016

(65) Prior Publication Data

US 2018/0084904 A1 Mar. 29, 2018

Related U.S. Application Data

(60) Provisional application No. 62/175,973, filed on Jun. 15, 2015.

(51) Int. Cl.
*A47B 21/06* (2006.01)
*A47B 21/04* (2006.01)

(52) U.S. Cl.
CPC ..... *A47B 21/06* (2013.01); *A47B 21/04* (2013.01); *A47B 2021/066* (2013.01); *A47B 2200/008* (2013.01); *A47B 2200/0075* (2013.01)

(58) Field of Classification Search
CPC ... A47B 21/06; A47B 21/04; A47B 2021/066; A47B 2200/0057; A47B 2200/0075; A47B 2200/008; A47B 2200/0066
(Continued)

(56) References Cited

U.S. PATENT DOCUMENTS 3,883,202 A * 5/1975 Konig ..... A47B 17/00 312/195
4,323,291 A * 4/1982 Ball ..... A47B 21/06 108/150

(Continued)

FOREIGN PATENT DOCUMENTS

DE 202013102469 9/2014
EP 0821898 2/1998

(Continued)

OTHER PUBLICATIONS

International Search Report and Written Opinion for application No. PCT/US2016/037691 dated Aug. 29, 2016.

(Continued)

*Primary Examiner* — Jose V Chen
(74) *Attorney, Agent, or Firm* — Workman Nydegger

(57) ABSTRACT

The present disclosure relates to modular and reconfigurable architectural assemblies such as modular walls and modular furniture, including modular and reconfigurable desk systems, with features and components that provide wire management functionality. A modular desk system includes a horizontal work surface and a lower vertical section extending vertically downward and/or upward from the work surface. At least a portion of the lower vertical section houses one or more resource trays having power and data receptacles for user wires to plug into. An access component such as a cover encloses the resource tray to provide a functional and aesthetically pleasing assembly while allow- (Continued)

ing management and organization of user wires and/or supply wires.

20 Claims, 18 Drawing Sheets

(58) Field of Classification Search
USPC ..... 108/50.01, 50.02
See application file for complete search history.

(56) References Cited

U.S. PATENT DOCUMENTS

| | | | | |
|---|---|---|---|---|
| 4,372,629 | A * | 2/1983 | Propst | A47B 21/06 248/52 |
| 4,654,756 | A | 3/1987 | Wilson et al. | |
| 4,734,826 | A * | 3/1988 | Wilson | A47B 21/06 361/729 |
| 4,762,072 | A * | 8/1988 | Boundy | A47B 21/06 108/50.02 |
| 5,231,562 | A * | 7/1993 | Pierce | A47B 21/06 108/50.02 |
| 5,237,935 | A * | 8/1993 | Newhouse | A47B 21/06 108/50.02 |
| 5,833,332 | A | 11/1998 | Marshal et al. | |
| 6,327,983 | B1 | 12/2001 | Cronk et al. | |
| 6,415,723 | B1 | 7/2002 | Kopish et al. | |
| 6,725,784 | B2 * | 4/2004 | Crinion | A47B 17/00 108/50.01 |
| 6,835,891 | B1 * | 12/2004 | Herzog | H02G 3/0418 174/135 |
| 6,895,868 | B1 * | 5/2005 | Cronk | A47B 21/06 108/50.02 |
| 7,703,398 | B2 * | 4/2010 | Brauning | A47B 1/08 108/155 |
| 7,926,430 | B2 * | 4/2011 | Bakker | A47B 21/06 108/25 |
| 8,146,514 | B2 * | 4/2012 | Hamilton | A47B 13/06 108/50.02 |
| 8,701,568 | B2 * | 4/2014 | Miller | A47B 21/00 108/50.02 |
| 8,893,628 | B2 * | 11/2014 | McKenzie, III | A47B 21/02 108/50.01 |
| 9,578,961 | B1 * | 2/2017 | Johnson | A47B 21/06 |
| 2005/0284341 | A1 * | 12/2005 | Klassy | A47B 21/00 108/50.02 |
| 2008/0121147 | A1 * | 5/2008 | Cooke | A47B 21/06 108/50.02 |
| 2009/0165680 | A1 | 7/2009 | Bakker et al. | |
| 2009/0273260 | A1 * | 11/2009 | Kemp | A47B 21/06 312/223.3 |
| 2010/0024687 | A1 * | 2/2010 | Preiss | A47B 21/06 108/50.02 |
| 2010/0024688 | A1 * | 2/2010 | Kitada | A47B 21/00 108/50.02 |
| 2011/0155867 | A1 | 6/2011 | Griepentrog | |
| 2014/0238277 | A1 * | 8/2014 | Fishman | A47B 37/00 108/25 |
| 2014/0331901 | A1 * | 11/2014 | Seefeldt | A47B 21/06 108/50.02 |
| 2016/0213145 | A1 * | 7/2016 | Johnson | A47B 83/001 |
| 2017/0042323 | A1 * | 2/2017 | Johnson | A47B 21/06 |
| 2018/0000240 | A1 * | 1/2018 | Yamamoto | A47B 9/20 |

FOREIGN PATENT DOCUMENTS

| | | |
|---|---|---|
| JP | 2010233595 | 10/2010 |
| JP | 2011104018 | 6/2011 |
| KR | 20070004364 | 1/2007 |

OTHER PUBLICATIONS

Supplementary European Search Report for application No. EP 16812369 dated Mar. 16, 2018.

* cited by examiner

MODULAR FURNITURE SYSTEM WITH WIRE MANAGEMENT

CROSS-REFERENCE TO RELATED APPLICATIONS

The present invention is a 35 U.S.C. § 371 U.S. National Stage of PCT Application No. PCT/US16/37691, filed on Jun. 15, 2016, which claims the benefit of priority to U.S. Provisional Application No. 62/175,973 filed Jun. 15, 2015. The entire content of each of the foregoing applications is incorporated herein by reference.

BACKGROUND

Technical Field

The present disclosure relates generally to modular architectural systems, and more particularly, to modular, reconfigurable furniture and wall systems comprising modular components and/or design elements, and to methods of assembling, (re)configuring, and/or using the same.

Background and Relevant Art

Modular architectural structures, such as modular furniture or wall systems, including modular desk systems, are often used in office environments to create work spaces for employees. The modular desks provide some flexibility in the shape of the desk and/or in the amount of space used by the desk. Modular desks may be used in situations where permanent desks are undesirable or impractical. Some previous modular desk systems may limit a user's ability to assemble, customize, reconfigure, reorient, rearrange, and/or replace the desk's modules.

There is also a need to be able to use desk system concepts, components, and features in commercial, residential, industrial, and other applications. In addition, there is a need for convenient and functional wire management within such desk systems and reconfigurable wall systems. Accordingly, there are a number of limitations related to conventional desk systems and other modular architectural structures.

BRIEF SUMMARY

Certain embodiments described herein overcome one or more problems in the art related to modular, reconfigurable architectural structures such as modular furniture and modular wall systems, including modular desk systems. One or more embodiments described herein include a substantially horizontal work surface having an upper side and a lower side. In some embodiments, the work surface is shaped to define one or more openings in the work surface. Some embodiments include a lower vertical section extending a distance below the work surface from the opening. The lower vertical section is configured to house a resource tray having one or more power receptacles and/or data receptacles for providing connections to one or more user devices that may be situated upon the work surface or otherwise associated with the desk system. In some embodiments, the opening provides access to the resource tray within an interior of the lower vertical section. The resource tray is configured to house one or more user wires extending to the upper or lower side of the work surface.

In some embodiments, the access component is a wire cover configured to overlie the opening to form a substantially flat surface across the work surface and the wire cover. In some embodiments, the wire cover includes one or more cover seals extending from a wire cover body to cover one or more edges of the opening. The one or more cover seals are configured to allow passage of one or more user wires from the resource tray to the upper side of the work surface when the wire cover is in the closed configuration.

In some embodiments, the lower vertical structure includes a support member for supporting the wire cover in a position substantially flush with the upper side of the work surface when the wire cover is in the closed position. In some embodiments, the support member further includes a pivot groove configured with a curved shape to enable a smooth tilting motion as the wire cover is lifted at a first end to move the wire cover from the closed configuration to the open configuration.

In some embodiments, the resource tray is at least partially defined by one or more tray panels. In certain embodiments, one or more of a rear edge of the work surface and an upper edge of a corresponding tray panel are angled to provide sufficient passage for plugs, user wires, and other components into the resource tray without unnecessarily extending the height of the resource tray. In some embodiments, one or more upper edges of the tray panel are angled so as to direct a spilled fluid away from the one or more receptacles of the resource tray.

In some embodiments, the resource tray includes one or more tray seals disposed beneath the work surface which are biased in a rearward direction against the tray panel. In certain circumstances, the one or more tray seals are configured to flex in a forward direction away from the tray panel to provide passage of one or more user wires between the resource tray and an area external to the resource tray underneath the work surface.

In some embodiments, an architectural assembly includes one or more vertical supports extending through the lower vertical section, at least one of the one or more vertical supports including a support spline having a notched section of reduced width to provide space for horizontal passage of one or more supply wires past the vertical support within the lower vertical section. Some embodiments further include one or more cantilevers each attached to a vertical support and extending substantially horizontally from the vertical support to support the work surface. Certain embodiments described herein also include a monitor system housing one or more monitors facing a first direction and one or more monitors facing a second direction.

Additional features and advantages of exemplary embodiments of the disclosure will be set forth in the description which follows, and in part will be obvious from the description, or may be learned by the practice of such exemplary embodiments. The features and advantages of such embodiments may be realized and obtained by means of the instruments and combinations particularly pointed out in the appended claims.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1A:
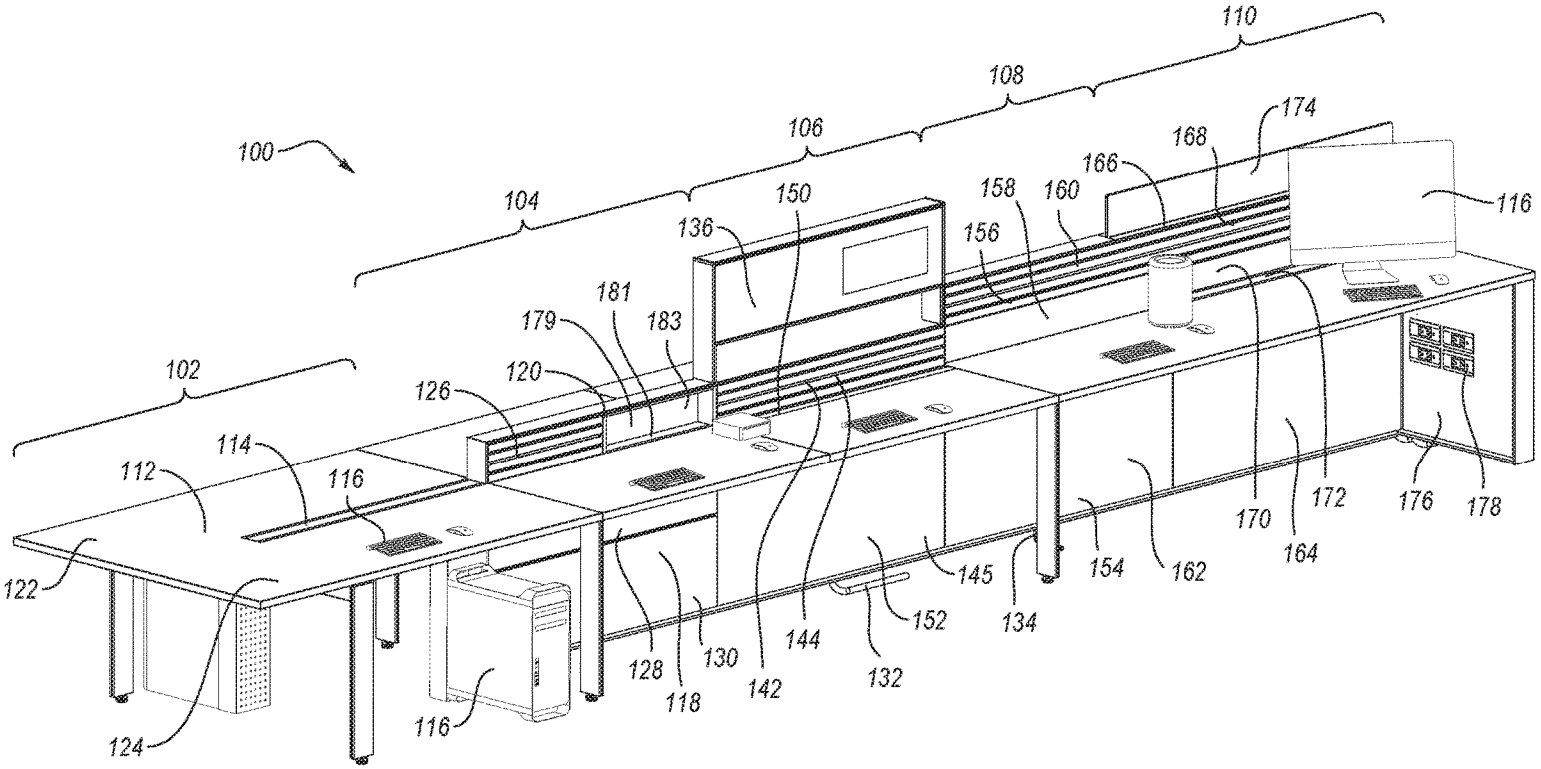
FIGS. 1A and 1B illustrate an exemplary modular, reconfigurable desk system having multiple sections of various configurations.

Embodiments described herein relate to modular and reconfigurable architectural systems, including modular and reconfigurable furniture (e.g., desks, tables, workspaces) and walls. One or more embodiments described herein include wire management capabilities that enable one or more of enhanced workspace efficiency, reduced clutter, improved organization, enhanced aesthetics, reduced wire and hardware visibility, minimized gaps at joints or between separate components, spill protection for sensitive components, and optimal use of available space.

Certain embodiments illustrated herein are described in the context of a modular and reconfigurable desk. It will be understood, however, that similar features, components, and/or concepts may be utilized to assemble or reconfigure a wall, table, cubicle, or other furniture structure having one or more wire management features. For example, where one or more regulations may distinguish between a wall and a piece of furniture based on a height measurement, one or more of the modular and reconfigurable systems described herein may be configured or modified in height so as to qualify as the desired type of structure for a particular application. In another example, an embodiment described in the context of a two-sided desk structure having work surfaces on either side of a common vertical divider may, in other embodiments, be configured with only one work surface extending from a rear vertical wall, or may omit any vertical walls extending from the work surface. Accordingly, embodiments described in the context of a desk configuration, wall configuration, or other particular type of configuration, are not limited only to those particular types of configurations.

At least some embodiments of reconfigurable desks described herein are configured to provide wire management features and components that function to organize and arrange wires so as to enhance the aesthetics and/or functionality of the reconfigurable desk. One or more embodiments described herein provide wire management for supply wires (i.e., "lay-in" wires) and/or user wires. As used herein, the terms "supply wires" or "lay-in wires" refer to wires, cables, or cords for supplying power, data, telephone lines, or other resources throughout various sections of the reconfigurable desk. For example, a supply wire may be a power cable that is connectable to a wall outlet or other external power supply, and that runs through at least a portion of the desk to enable delivery of power to one or more sections of the desk (e.g., to one or more built-in power outlets). In another example, a supply wire may be a data cable (e.g., Ethernet cable) that is connectable to a wall data supply or other external data source, and that runs through at least a portion of the desk to enable delivery of data to one or more sections of the desk (e.g., to one or more built-in data connections).

As used herein, the term "user wires" and similar terms refer to wires, cables, or cords associated with one or more user devices that may positioned on, attached to, integrated with, or otherwise associated with a reconfigurable desk. Examples of user wires include, but are not limited to, computer device wires, keyboard cables, USB cords, and data or power cables (e.g., for computers, printers, lamps, monitors, scanners, fans, and the like). User devices suitable for use with one or more of the embodiments described herein include office or workstation devices such as computers, printers, monitors, scanners, keyboards, mouse controls, and the like; videogame components; audiovisual display components; virtual or augmented reality components such as headsets, tracking cameras, and the like.

As used herein, the term "rear," "rearward," and the like refer to a horizontal direction extending from a front edge of work surface, (e.g., nearest a user), of an architectural structure toward a vertical section, divider, and/or resource tray at or further toward the middle of the architectural structure or toward the back of the architectural structure. As used herein, the term "forward" and similar terms refer to a horizontal direction extending from a vertical section, divider, and/or resource tray of an architectural structure toward a front edge of a work surface (e.g., toward a user) of the architectural structure. The terms "horizontal" and "vertical" are used throughout the description for simplicity. It will be understood, however, that components and/or relationships described as being such need not be perfectly horizontal or vertical, but include angular measures that are about 0-30, 0-20, 0-10, or 0-5 degrees off from horizontal or vertical.

Figure 1B:
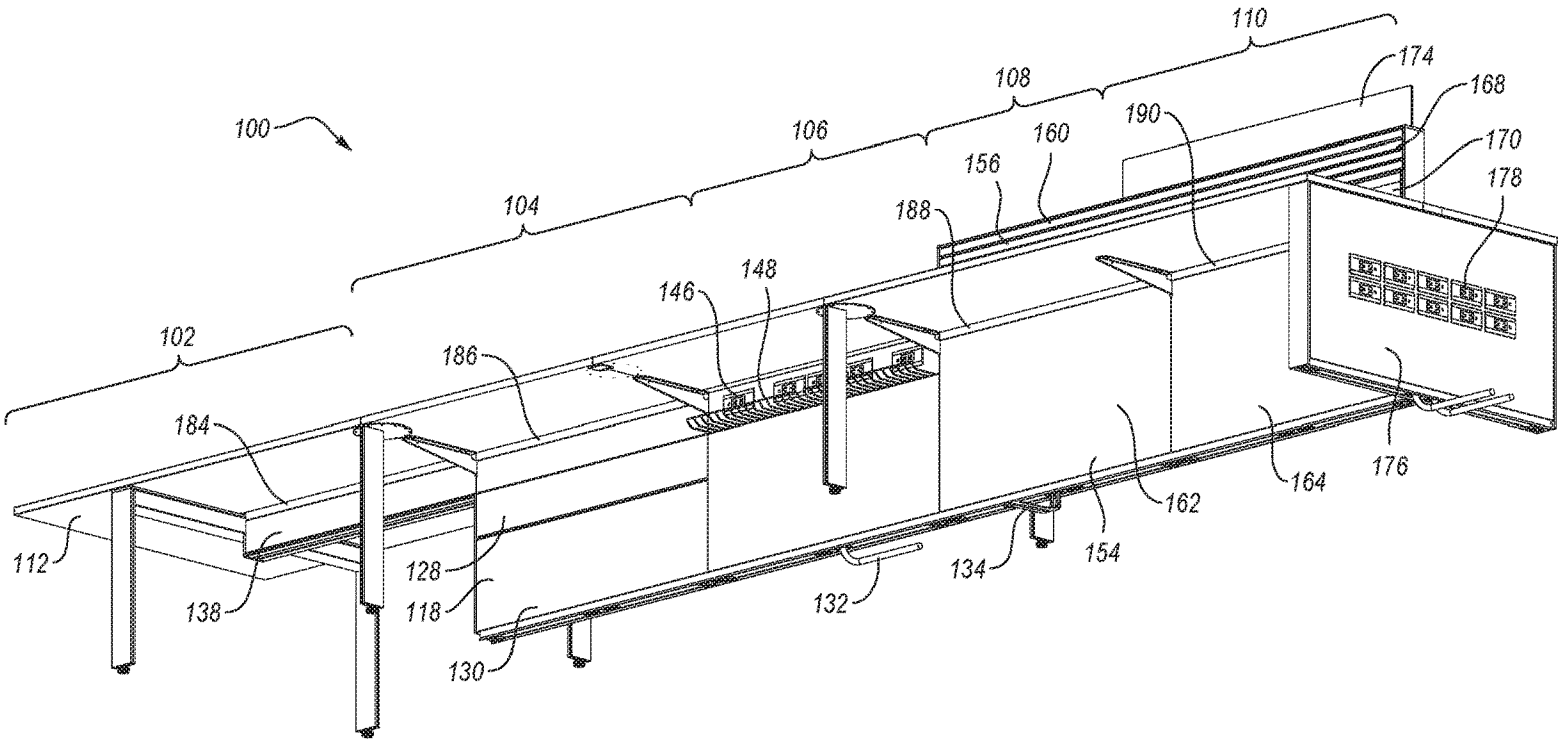
Figure 1C:
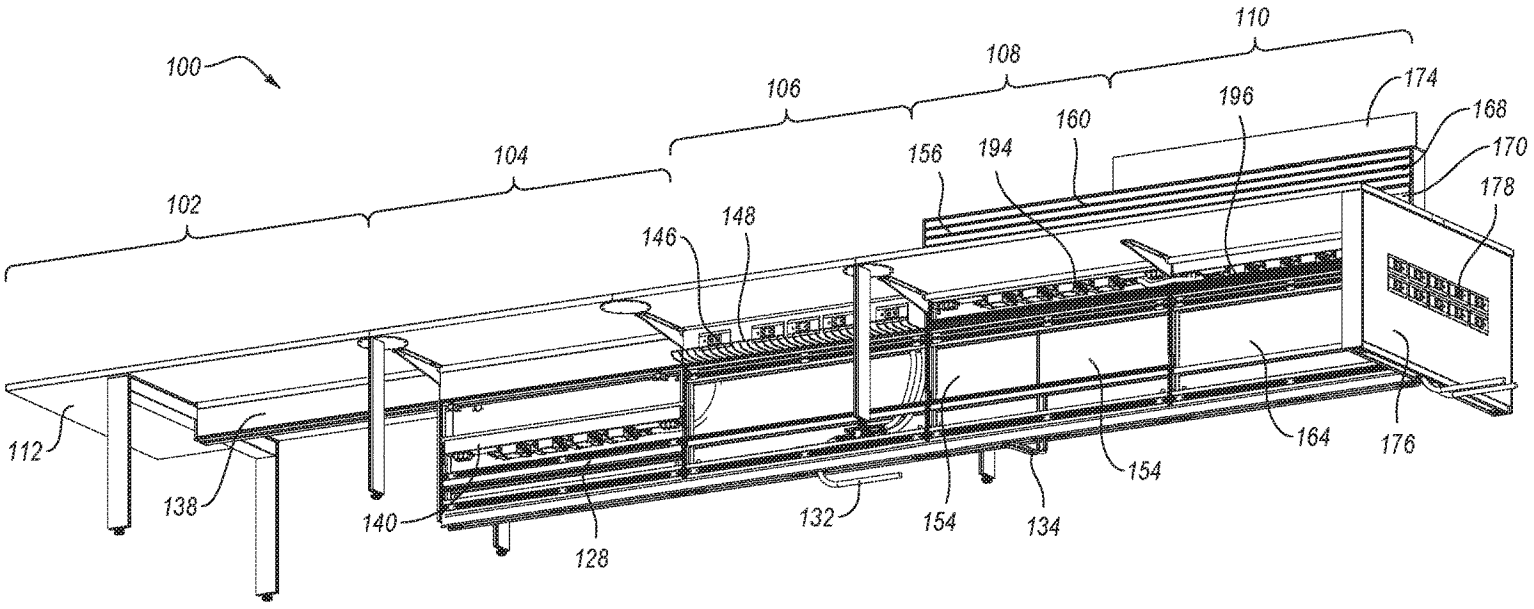
FIG. 1C illustrates the desk system of FIGS. 1A and 1B with various outer panels removed to show interior components of the desk system.

FIGS. 1A-1C illustrate an example of a modular, reconfigurable desk system 100 having wire management functionality. FIG. 1A illustrates an isometric view of the upper side of the desk system 100, FIG. 1B illustrates an isometric view of the lower side of the desk system 100, and FIG. 1C illustrates the view of FIG. 1B with several access panels removed to show various interior components of the desk system 100.

The illustrated desk system 100 includes a work surface 112 (on each of a first side 122 and a second side 124) extending across various different sections 102, 104, 106, 108, and 110, each arranged in a different exemplary configuration. Although multiple different sections are illustrated, each having a different particular configuration, it will be understood that other embodiments include components and features of one or more of the illustrated sections, or include combinations of components and features from one or more of the different illustrated sections. Accordingly, some embodiments of desk systems are configurable to provide desired functionality for a particular implementation, and may also be reconfigured to adjust particular functionality as needs or desires change.

The illustrated desk system 100 is shown with a variety of user devices 116 situated with the desk system 100. As shown, the user devices 116 can be computer bases, computer monitors, keyboards, and the like. The illustrated desk system 100 also includes an integrated monitor system 136, which may include one or more integrated monitors facing in either direction, as described in more detail below.

As shown, a first section 102 is configured as an open-style workstation having minimal vertical structure extending upwards or downwards from the horizontal work surface 112. The first section 102 includes a wire cover 114 situated along the top side of at least a portion of the work surface 112. The work surface 112 and/or wire cover 114 may be formed from one or more of a wood material, polymer material, metal material, or other suitable material. In preferred embodiments the work surface 112 and the wire cover 114 are formed at least partially from a medium density fiberboard (MDF).

The wire cover 114 provides access to a resource tray 138 (open view shown in FIG. 2) disposed below the work surface 112 and having one or more integrated power and/or data connections (e.g., receptacles). As described in more detail below, the resource tray 138 and the wire cover 114 enable management of user wires associated with one or more user components 116 situated upon or associated with the first section 102. For example, a user may position a laptop computer device or a computer monitor upon the work surface 112, and may use the resource tray, accessed through the wire cover 114, to route associated user cables to the power and/or data connections of the resource tray.

The illustrated desk system 100 includes a second section 104 configured to include a lower vertical section 118 extending from the work surface 112 toward the floor and an upper vertical section 120 extending upwards from the work surface 112. The upper vertical section 120 extends a relatively short distance upwards (e.g., about 6 to 18 inches) to provide a level of privacy between a first side 122 and a second side 124 of the desk system 100. In other embodiments, the vertical section 120 (and/or any of the other upper vertical sections described herein) may be configured to extend a shorter amount (e.g., less than 6 inches, or about 6 to 12 inches), or may extend a greater amount (e.g., 18 to 48 inches, or greater than 48 inches). In some embodiments, the upper vertical section 120 is configured to extend to a ceiling or near to a ceiling (e.g., about 5 to 10 feet) so as to form a more complete visual and/or sound separation between the first side 122 and second side 124.

As shown, the upper vertical section 120 includes a slat wall 126 enabling the positioning of accessories, such as trays, shelves, photographs, monitor mounts, and the like, within one or more slats of the slat wall 126. For example, one or more accessories may be situated on the slat wall 126 and be structurally supported by the slat wall 126. The illustrated upper vertical section 120 also includes a pocket 179 providing access to a wire cover 181 (which may be configured similarly to wire cover 114). As shown, the pocket 179 includes a back wall 183 to provide privacy between users situated on opposite sides of the desk system 100. In the illustrated embodiment, the upper vertical section 120 is rotationally symmetrical, such that the slat wall 126 functions as a back wall of a pocket to a user situated on the first side 122, and such that the back wall 183 functions as a slat wall to a user situated on the first side 122.

In some embodiments, power and/or data connections of the resource tray 138 run underneath the work surface 112 of other illustrated sections, and are accessible via, for instance, the wire cover 181 in section 104. For example, the wire cover 181 may be rotated upwardly to move from a closed position to an open position to provide access to the interior of the resource tray.

In the illustrated embodiment, the lower vertical section 118 includes a hinged access tile 128 on one or both sides of the vertical section, providing access to a lower resource tray 140 having one or more power and/or data connections. For example, a user may position a computer base below the work surface 112 of the second section 104, and may plug the computer base into one or more power or data connections of the lower resource tray by opening the hinged access tile 128 to route the power and/or data cables of the computer base into the lower resource tray.

The illustrated second section 104 also includes a lower access tile 130. In some embodiments, the lower access tile 130 is removable to provide access to supply wires or other interior components of the lower vertical section 118. For example, in the illustrated embodiment, a power cable 132 and data cables 134 are routed into various lower vertical sections, including lower vertical section 118, for integration with upper and/or lower resource trays. Such single or double-sided access to resource trays and the trays themselves may be positioned above as well as below the work surface for desired functionality, and supply wires 132 and 134 may be routed to locations above the work surface 112 as well.

As shown, a third section 106 includes an upper vertical section 142 having a slat wall 144, which may be configured similar to the slat wall 126 of the second section 104. In this embodiment, the upper vertical section 142 is configured to provide passage of one or more supply and/or user wires from below the work surface 112 to a position above the work surface 112, or vice versa. For example, one or more power or data supply cables may be routed through the lower vertical section 145 to the interior of the upper vertical section 142. The third section 106 also includes a lower access tile 152 detachably joined to a lower vertical section 145 so as to provide access to supply wires or other components in the interior of the lower vertical section 145.

As best shown in FIG. 1B, the third section 106 includes a set of sideways-facing receptacles 146 and a wire tray 148 positioned below the sideways-facing receptacles 146 to support and manage user wires plugged into or otherwise associated with one or more of the sideways-facing receptacles 146. The sideways-facing receptacles 146 and wire trays 148 are also shown in enlarged view in FIG. 4.

The work surface 112 of the third section 106 includes a seal 150 (also visible in FIG. 7) positioned over a gap between the work surface 112 and the upper vertical section 142. The gap allows passage of user wires from the wire tray 148 and/or sideways-facing receptacles 146 to the upper side of the work surface 112, and vice versa. The seal 150 beneficially lies over the gap to cover the opening while still allowing wires to be passed through the gap. In preferred embodiments, the seal 150 is formed from a material that seats across the gap but has sufficient flexibility so as to flex upward for passage of one or more wires underneath the seal 150 at one or more desired locations. In preferred embodiments, the seal 150 is formed from a polymer material such as a polyvinyl chloride material formulated to provide a desired balance of rigidity and flexibility.

For example, relatively rigid portions of the seal 150 may allow fastening to the work surface with adhesives, tapes, staples, or fasteners, for instance, while relatively flexible portions of the seal 150 may provide wire containment and visual cover for user wires, while allowing flexibility to bend out of the way for wires to pass from above to below the work surface 112. The use of relatively rigid portions and/or relatively flexible portions may apply to any of the various shapes of seals described herein, each shaped to conform to a particular location and sized for relevant functions. In some embodiments, the seal 150 is mounted to a hingedly attached rear portion of the work surface 112, enabling the seal to pivot up and away to allow for larger objects (e.g., the plug of a power cord) to pass from below the work surface 112 to above it and vice versa.

As shown, a fourth section 108 includes a lower vertical section 154 and an upper vertical section 156. In the illustrated embodiment, the upper vertical section 156 includes a hinged access cover 158 providing access to a resource tray 194 (shown in FIG. 1C) disposed below the work surface 112 within an upper portion of the lower vertical section 154. The resource tray 194 is configured similar to the resource tray of the first section 102, and includes one or more data and/or power connections/receptacles to which one or more user wires may be routed. As shown, the upper vertical section 156 of the fourth section 108 also includes a slat wall 160, which is configured for structurally supporting one or more attached accessories. A detachable lower access tile 162 provides access to the interior of the lower vertical section 154, within which one or more supply wires may be routed to the resource tray 194.

The illustrated upper vertical section 156 and lower vertical section 154 are shown as having a particular arrangement of tiles/walls. In other embodiments, the upper vertical section 156 and/or lower vertical section 154 (as with other upper or lower vertical sections described herein) include one or more non-slatted covers, covers hinged so as to swing downward or to the side to open, covers that are detachable, and covers that are slidable or configured to provide access to the interior of a corresponding upper vertical section in some other fashion. In some embodiments, the upper vertical section 156 is openable to provide access to supply and/or user wires housed within. For example, the hingedly attached cover 158 may be rotated upward to move from a closed position to an open position.

As shown, a fifth section 110 includes a lower vertical section 164 and an upper vertical section 166. In the illustrated embodiment, the upper vertical section 166 includes a slat wall 168 raised a distance off of the upper side of the work surface 112 to define a window 170. The illustrated configuration beneficially allows passage of papers or other items through the window 170 from one side of the desk system 100 to the other. The fifth section 110 also includes a resource tray 196 (shown in FIG. 1C) covered by a wire cover 172 and accessible by lifting or removing the wire cover 172. The resource tray 196, disposed beneath the cover 172 within an upper portion of the lower vertical section 164, includes one or more power and/or data receptacles for connecting one or more user wires.

The fifth section 110 also includes a glass panel 174 extending upwards from the slat wall 168. The glass panel 174 may be extended to a desired height for a desired implementation of the desk system 100. In some embodiments, an upper vertical section includes one or more of a slat wall, glass panel, non-slatted wall, window, hinged access tile, or other wall structural element. The one or more various wall structural elements may be arranged in any order, pattern, or alternating assembly to provide a desired configuration.

The illustrated desk system 100 also includes an end wall 176 extending vertically from the work surface 112 to the floor and being positioned transverse to the lower vertical section 164 so as to further define a lower space beneath the work surface 112. In the illustrated embodiment, the end wall 176 includes a plurality of receptacles 178, which are arranged to face in a sideways direction (e.g., similar to the sideways-facing receptacles 146 of the third section 106). As shown, the illustrated end wall 176 includes a set of receptacles 178 on both a first side (facing toward the desk system 100) and a second side (facing away from the desk system 100) which may be positioned directly back to back, each occupying its own half of the wall volume. The receptacles 178 enable connection of one or more user components, such as computer bases, a printer/copier station, and/or other user components. The relatively high density of the receptacles 178 on the end wall 176 beneficially enables the use of high-receptacle-demand user devices (e.g., copier stations, network server stations) by situating such user devices in relation to the end wall 176.

Some embodiments described herein may also include one or more components which are positioned external to a vertical section and which are configured for routing user wires or supply wires in a desired manner. For example, one or more chases (e.g., formed from a polyvinyl chloride extrusion with desired rigidity/flexibility) may be positioned upon a lower vertical section (e.g., at a 90 degree corner such as a corner formed by end wall 178 and lower vertical section 164) to channel and route user wires through the chase while hiding them from sight and/or protecting them from contact with other components of the desk system 100.

As best shown in FIG. 1B, the desk system 100 includes a plurality of seal elements 184, 186, 188, and 190 each associated with a corresponding resource tray. For example, the seal element 184 is associated with the resource tray 138. A seal element is configured to provide passage of one or more user wires into and/or out of a corresponding resource tray. As explained in more detail below, at least some embodiments of seal elements are also configured in conjunction with one or more other components to provide beneficial functionality to a desk system.

Figure 2:
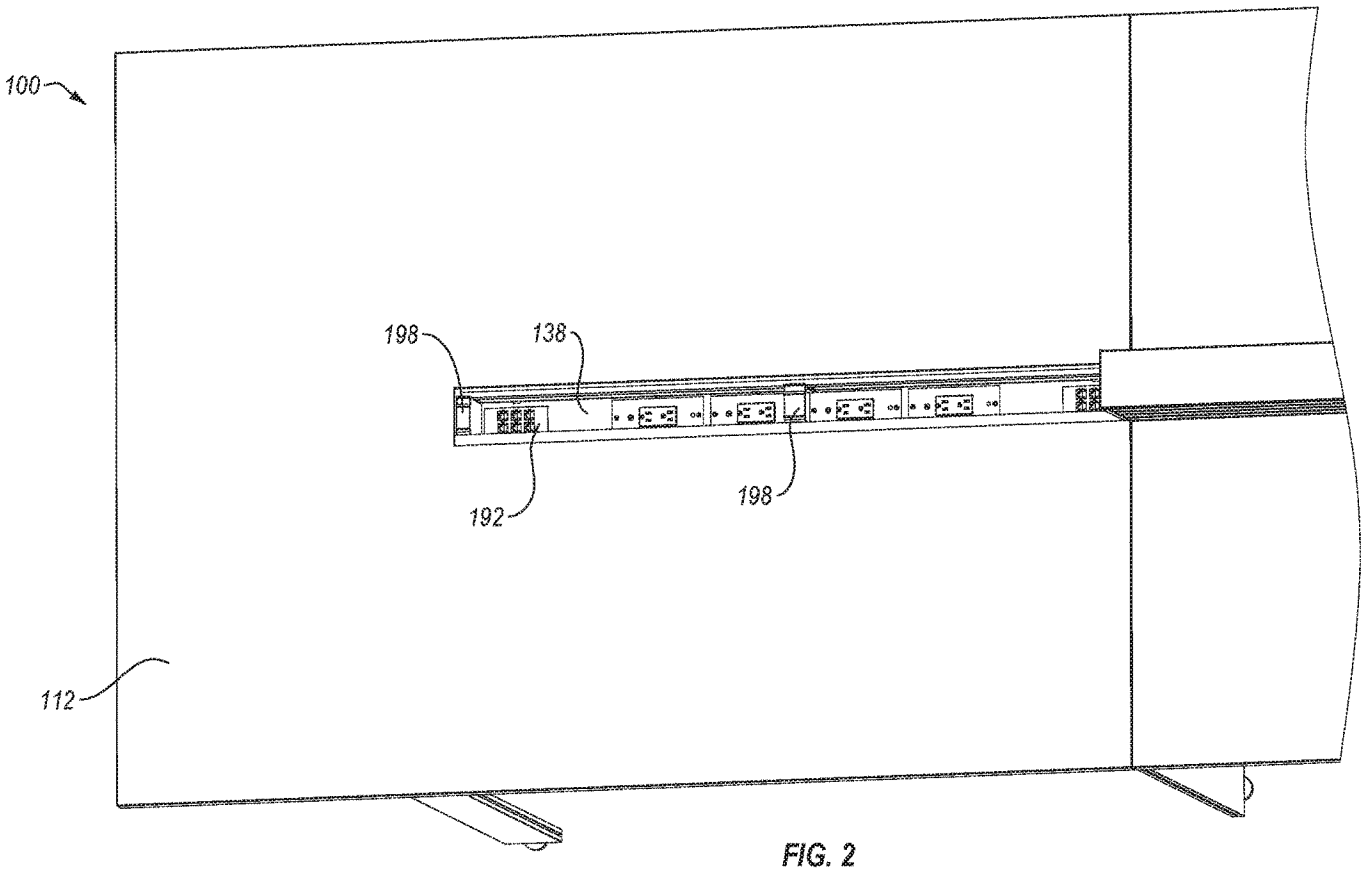
FIG. 2 illustrates a planar view of a first section of the desk system, showing the interior of a resource tray disposed within the desk system.

FIG. 2 illustrates a plan view of the first section 102 of the desk system 100. In this view, the wire cover 114 is removed to illustrate the interior of the resource tray 138. As shown, the resource tray 138 includes a plurality of upward-facing power and data receptacles 192. The illustrated resource tray 138 also includes support members 198 configured to support the wire cover 114 and to enable rotatable movement of the wire cover 114 for access into the resource tray 138, as described in more detail below.

Figure 3:
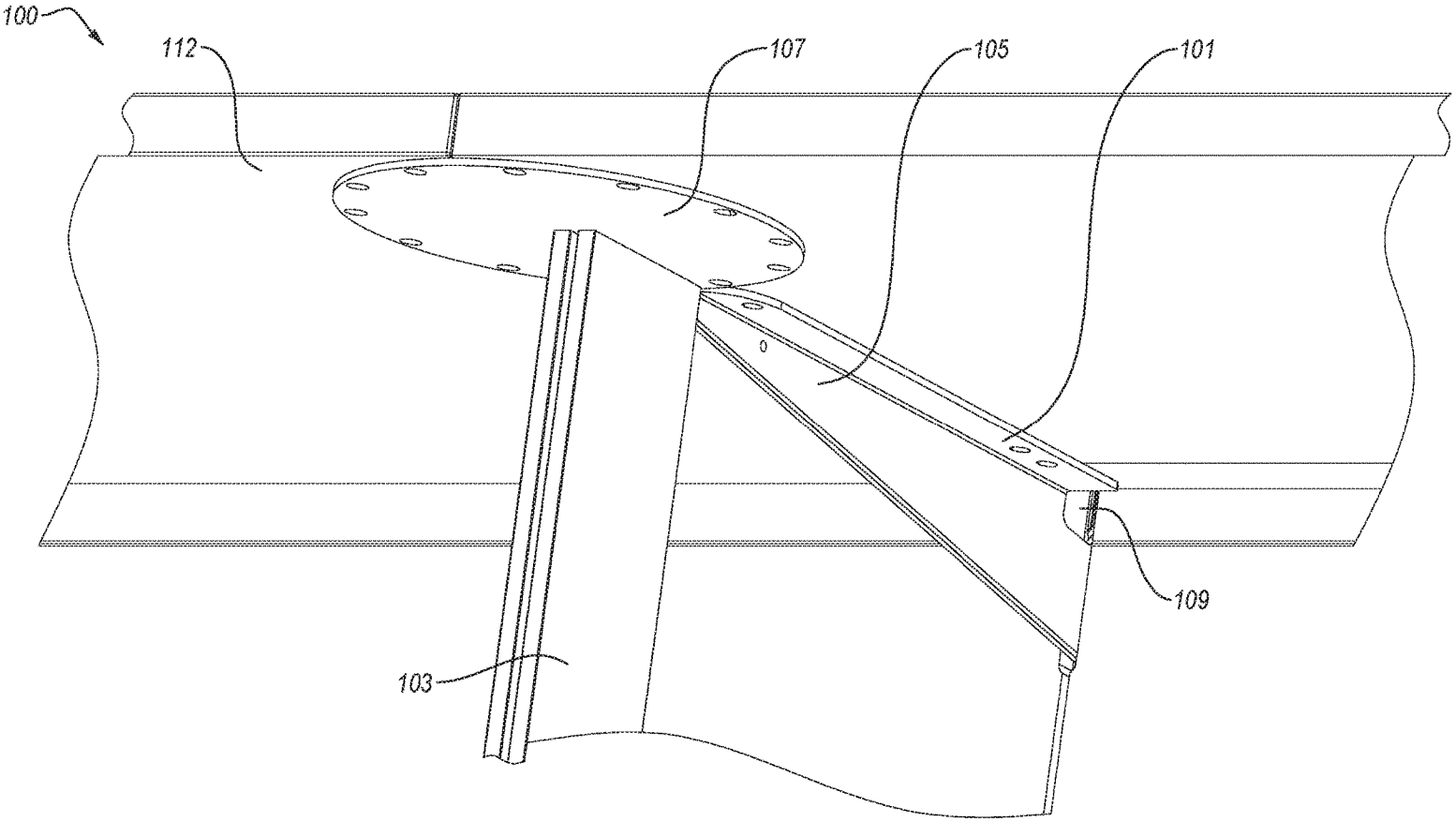
FIG. 3 illustrates a view of a cantilever device and a leg of the desk system.

FIG. 3 illustrates a view of the underside of the work surface 112 showing attachment of the work surface 112 to a cantilever 101 and a leg 103. In this embodiment, the cantilever 101 is formed from a pair of cantilever halves. An alignment hole 105 passes through each cantilever half such that the halves may be aligned by positioning a setscrew, pin, or other suitable object within the alignment hole 105. FIG. 3 also illustrates a leg plate 107 having a plurality of radially positioned holes for joining the leg 103 to the work surface 112. The leg plate 107 includes multiple radially positioned holes (e.g., 12 in the illustrated embodiment) enabling the leg 103 to be rotated to a corresponding number of different orientations using the same drilling in the bottom of the work surface 112.

As shown, the cantilever 101 includes a notch 109 disposed near a rear end of the cantilever 101 where the cantilever 101 joins to the lower vertical section 118. The notch 109 beneficially allows horizontal passage of one or more user wires from one side of the cantilever 101 to the other. Such a routing configuration beneficially keeps the wire relatively snug against the underside of the work surface 112. Routing through the notch 109 also avoids the necessity of using up greater lengths of the wire just to loop around the cantilever 101. Such loops also position the wire where it is more likely to be unintentionally caught or snagged.

In one example, a user may route a user wire down from the upper side of the work surface 112 to the lower side of the work surface 112, and then may desire to route the wire horizontally to another user device or to a power or data connection located at a different horizontal position. The cantilever 101 having the notch 109 enables such routing in an effective manner that minimizes the amount of user wire remaining visible at the upper side of the work surface 112. In the illustrated embodiment, the cantilever 101 and the leg 103 are formed as separate elements. In other embodiments, a leg is coupled to a cantilever as an integral cantilever/leg unit.

Figure 4:
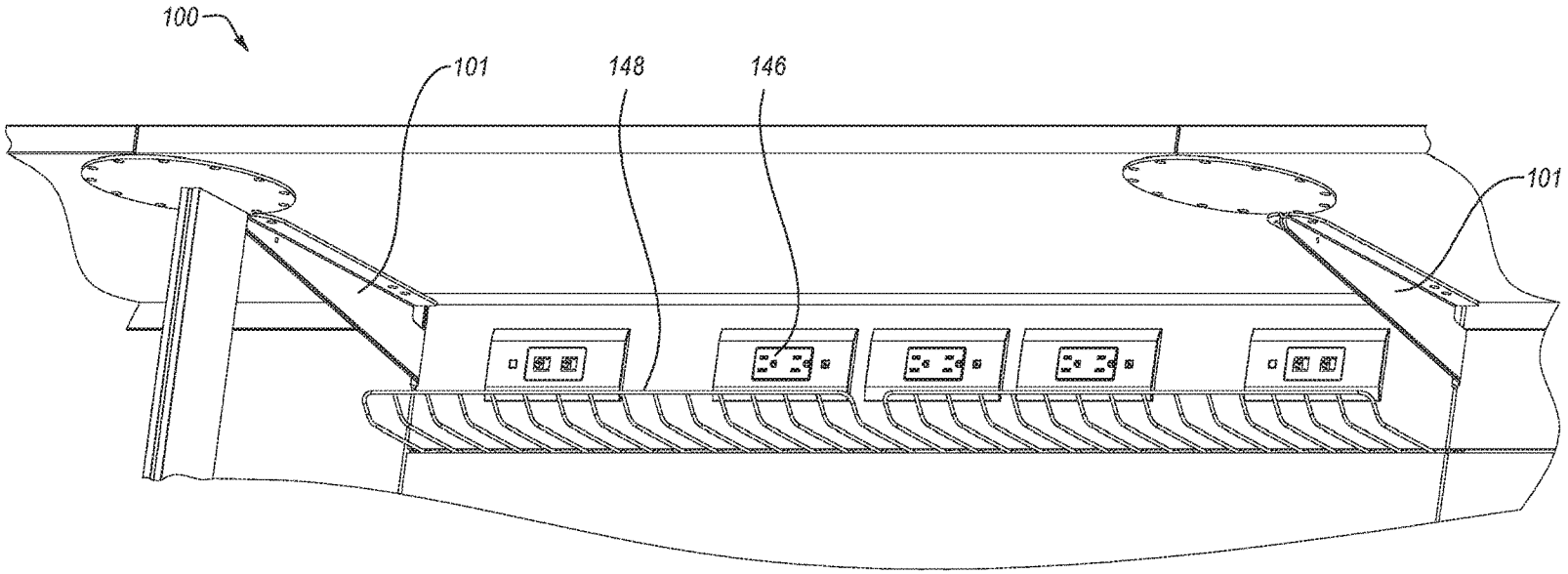
FIG. 4 illustrates an enlarged view of another section of the desk system, showing a set of sideways-facing receptacles and associated wire trays.

FIG. 4 illustrates an enlarged view of the desk system 100 showing the sideways-facing receptacles 146 and associated wire tray 148. When one or more devices are connected at one or more of the sideways-facing receptacles, excess lengths of user wire may be supported by and/or positioned on the wire tray 148 to manage the wire and reduce wire clutter, for example. In some implementations, the sideways-facing receptacles 146 and associated wire tray 148 are used to connect and manage power cords having transformer boxes or other types of user wires having components that are particularly well suited for support by the wire tray 148. For example, a user may desire that a particular type of user device or user wire having relatively larger associated components (such as an in-line transformer) be connected at the sideways-facing receptacles 146, where the wire tray 148 can support the larger components. As desired, such user wires may then be routed horizontally to different sections of the desk system 100 (e.g., by passing through the notches 109 in the cantilevers 101).

The illustrated desk system 100 may make use of various frame and/or trim elements to configure one or more tiles, panels, and/or other structural components in a desired fashion. In some embodiments, different types of tiles, panels, and/or other structural components are interchangeably connectable to form desired modular arrangements of the desk system 100. Tiles, panels, and/or other structural components that may be utilized in one or more embodiments described herein are described in PCT Application No. PCT/US2015/015920, filed Feb. 13, 2015, and entitled "Method of Reconfiguring Walls," the entirety of which is incorporated herein by this reference.

Figure 5:
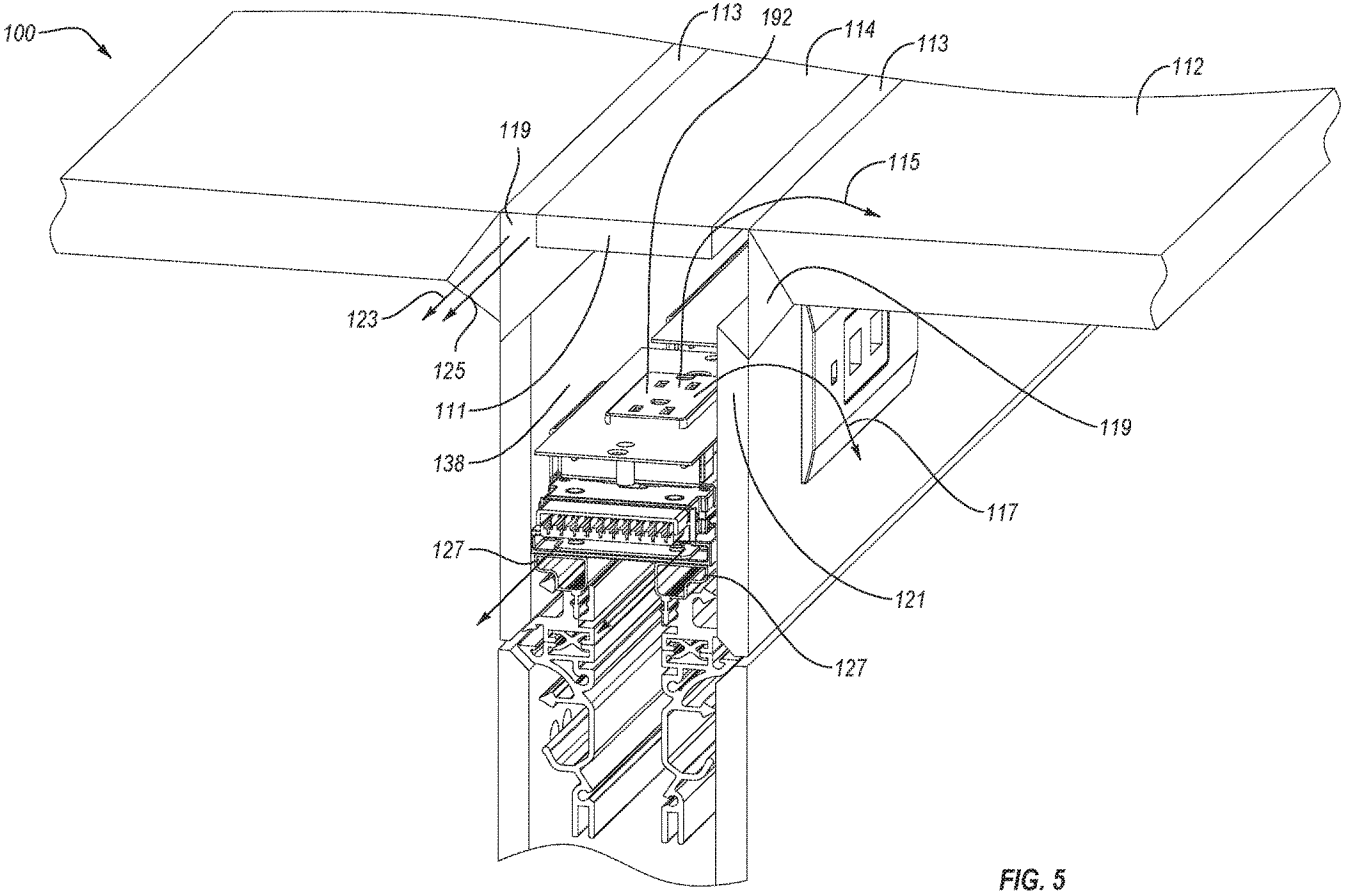
FIG. 5 illustrates a cross-sectional view of the desk system showing the resource tray and showing exemplary user wire and supply wire routing with respect to the resource tray.

FIG. 5 illustrates a cross-sectional view of the desk system 100 showing various components associated with the resource tray 138 and showing various wire management capabilities provided by the resource tray 138 and associated components. As shown, the wire cover 114 includes a body 111 and a pair of cover seals 113 extending from each side of the body 111 so as to cover the resource tray 138 when the wire cover 114 is in a closed position.

A user wire may be passed from the resource tray 138 to the upper side of the work surface 112 by traversing the path shown by arrow 115. As shown, the user wire is passed from the receptacle 192 to the upper side of the work surface 112 by passing underneath the cover seal 113 of the wire cover 114. A user wire may be passed from the resource tray 138 to the underside of the work surface 112 by traversing the path shown by arrow 117. As shown, the user wire is passed from the receptacle 192 to the underside of the work surface 112 by passing between a tray seal 119 and an upper edge of a tray panel 121. One or more user wires may also be routed horizontally on either side of the tray seal 119 as shown by arrows 123 and 125.

FIG. 5 also illustrates management of one or more supply wires with respect to the resource tray 138. As shown, one or more supply wires may be routed through one or more of the channels 127 disposed underneath the resource tray 138. For example, supply wires connected to the receptacles 192 of the resource tray 138 may be routed to respective receptacles through the channels 127. Additionally, or alternatively, the channels 127 may be utilized to route one or more supply wires to other sections of a desk system as needed or desired. In some embodiments one or more channels 127 are omitted or not used, and the supply wires may pass through voids in the same or nearby location. In some embodiments, one or more of the channels 127, the tray seals 119, and the cover seals 113 are formed from an extruded polymer material, such as an extruded poly-vinyl chloride material formulated to provide desired material properties.

Figure 6A:
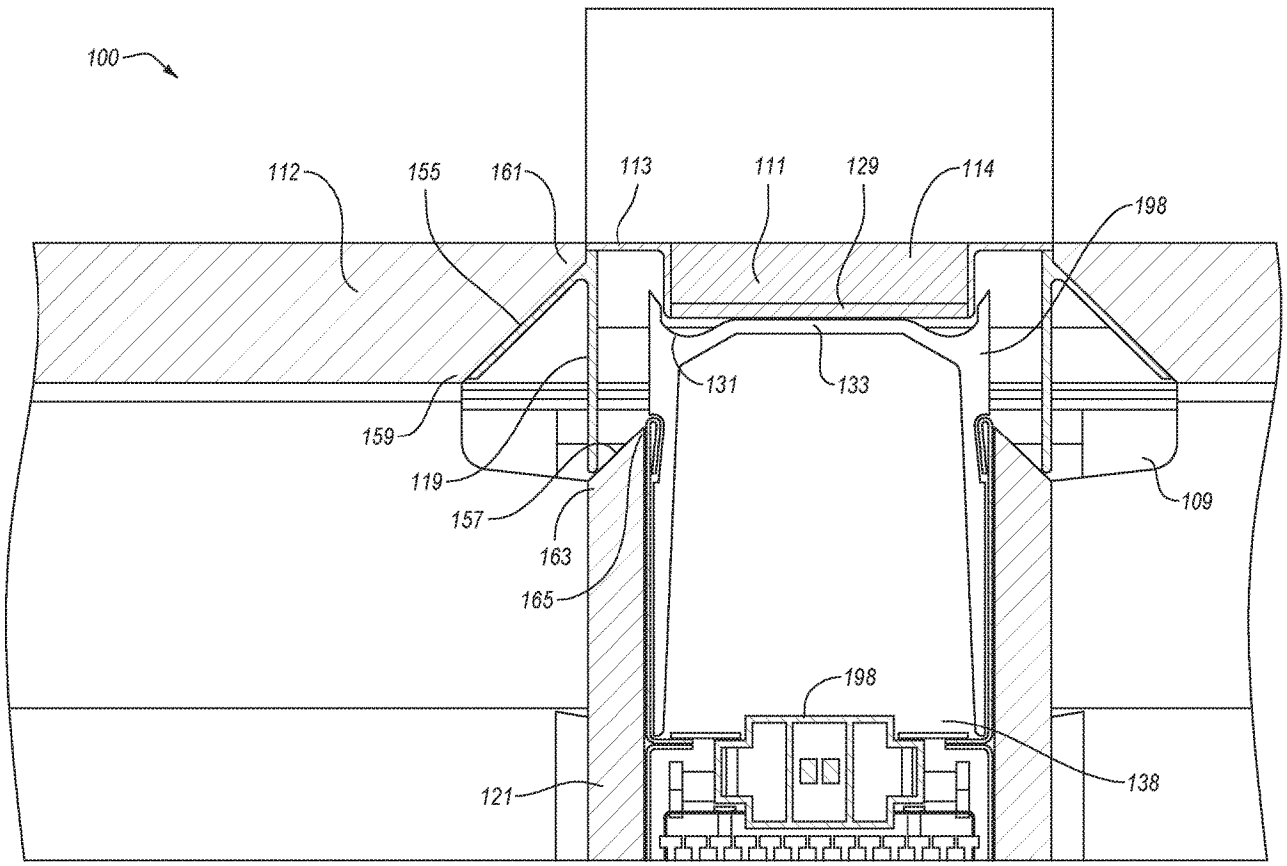
FIGS. 6A-6C illustrate cross-sectional views of the desk system showing the resource tray and showing a wire cover in a closed, tilted, and removed position, respectively.
Figure 6B:
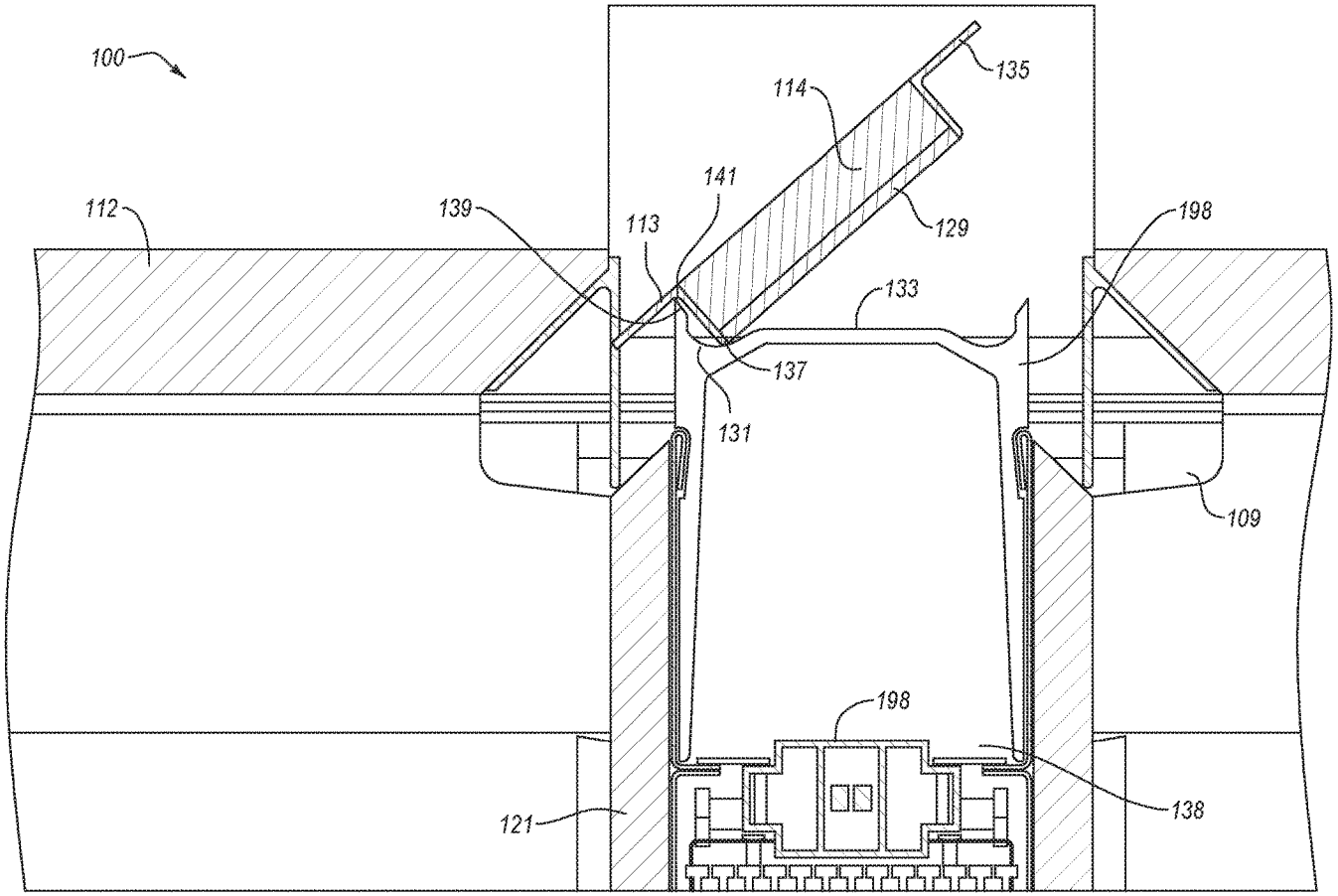
Figure 6C:
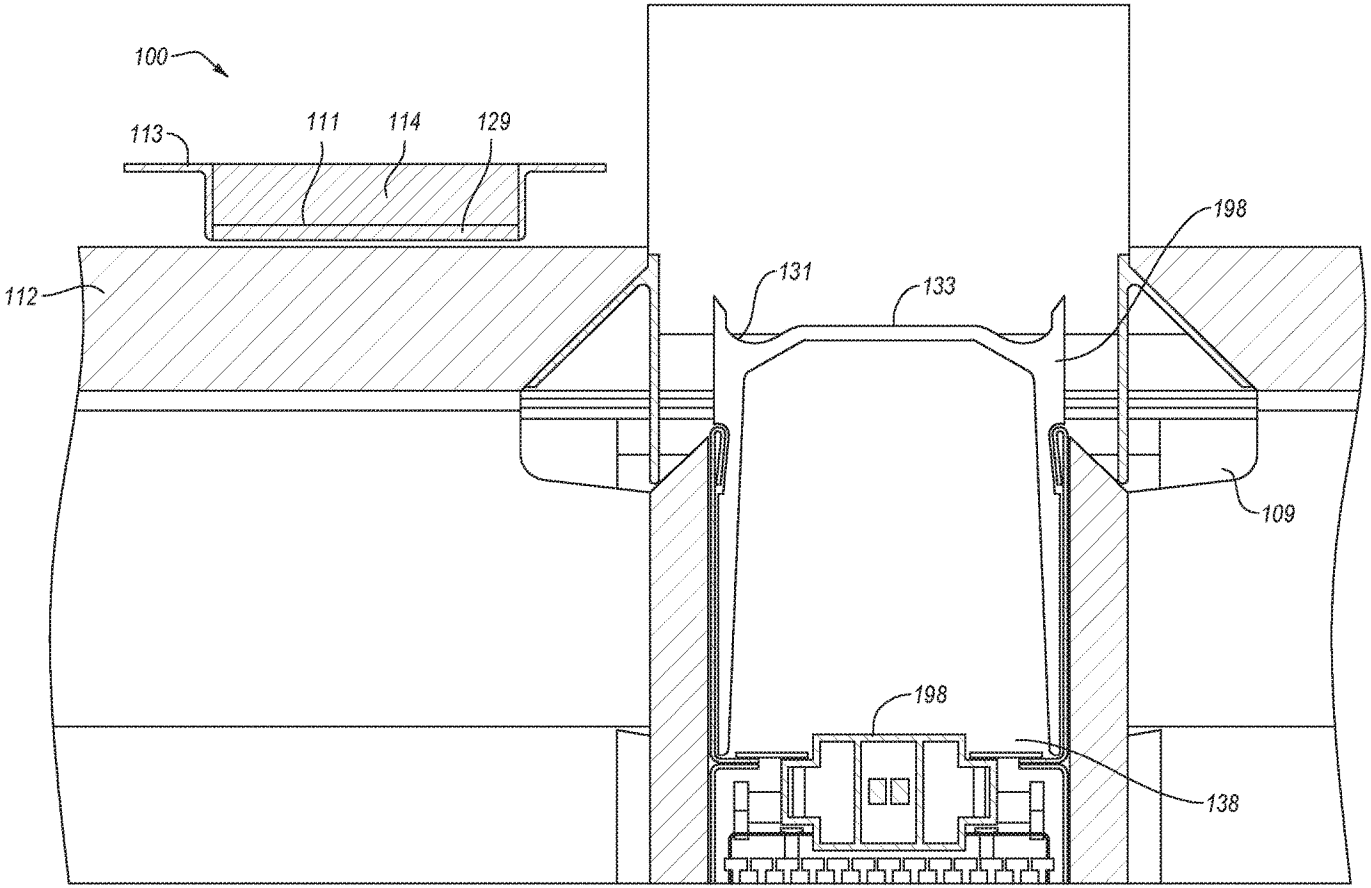

FIGS. 6A-6C illustrate a cross-sectional view of the desk system 100 showing interaction between the wire cover 114 and a support member 198. The illustrated support member 198 is suitable for use at a middle section of the resource tray 138. Additional support members, similarly configured, may also be positioned at one or more ends of the resource tray 138 and/or at other locations along the length of the resource tray 138. The body 111 of the cover 114 is thinner than the work surfaces 112 to maximize wire management space in the resource tray 138 below the cover 114 without requiring the receptacles 192 to be positioned further down than necessary. The illustrated wire cover 114 also includes a weighted section 129 (e.g., formed of steel or material of similar density) configured to weigh the cover down against upward pushing wires or wire bundles.

FIG. 6A illustrates the wire cover 114 in a closed positon. As shown, the body 111 of the wire cover 114 is supported by the support member 198 so that it rests at a height where the cover seals 113 are flush with the upper side of the work surfaces 112. The illustrated support member 198 includes a pivot groove 131 near each edge of the support member 198, and a straight section 133 extending between the pivot grooves 131. When the wire cover 114 is in the closed position, as shown in FIG. 6A, the wire cover body 111 rests upon the straight section 133.

FIG. 6B illustrates the wire cover in a tilted position providing access to the underlying resource tray 138. For example, a user may lift on one side of the wire cover 114 to move the wire cover 114 to the tilted position to provide access to the resource tray 138. The pivot groove 131 opposite the lifted end 135 of the wire cover 114 is configured in size and shape to enable a pivoting corner 137 to slide within the corresponding pivot groove 131 to guide the motion of the wire cover 114 as it is lifted toward the tilted position. For example, the curved shape of the pivot groove 131 functions to allow the pivoting corner 137 a degree of downward movement and a degree of horizontal movement in the direction of the lifted end 135 to provide a smoother pivoting motion when moving from the closed position to a tilted position.

In the illustrated embodiment, each pivot groove 131 also includes an edge extension 139 which extends upwards to engage against a cover corner 141 to act as a stop against further pivoting motion of the wire cover 114 while rotated, and to horizontally (forwardly and rearwardly) position the wire cover 114 in the desired location when in the closed position. Although FIG. 6B shows one end of the wire cover 114 lifted to form an open tilted position, it will be understood that the same effect may be achieved by lifting the opposite end of the wire cover. For example, the mirror-image configuration of the illustrated embodiment enables different users positioned on either side of the wire cover 114 to access the resource tray 138 by tilting the wire cover in opposite respective directions.

FIG. 6C illustrates the wire cover 114 in a removed position for providing even greater access to the resource tray 138. For example, a user desiring to connect and/or house a relatively larger transformer, tie a bundle of user wires, or otherwise have full access to the resource tray 138 may remove the wire cover 114 from the support member 198, as shown. After desired tasks have been accomplished, the wire cover 114 may be repositioned upon the support member 198 to move the wire cover back into the closed position shown in FIG. 6A. FIGS. 6A-6C also illustrate the cantilever notches 109 through which one or more user wires may be passed.

Referring to FIG. 6A, the illustrated embodiment also shows a configuration where the work surfaces 112 are formed with angled rear edges 155, and the tray panel 121 is formed with angled upper edges 157. For a given side of the desk system 100, the angled rear edge 155 and the angled upper edge 157 form an angled passage leading from an area outside of the resource tray 138 and underneath the work surface 112 to the interior of the resource tray 138. The minimum distance between the angled rear edge 155 and the corresponding angled upper edge 157 is preferably about 0.75 to 2 inches, or about 1 to 1.5 inches, or about 1.25 inches, so as to be able to allow passage of a standard power plug.

The angled passage beneficially allows the resource tray 138 and its contents to be raised to a relatively higher position. In contrast, if the rear edge 155 and/or upper edge 157 were not angled, the minimum distance between the respective components would be reduced, and the resource tray would need to be lowered relative to the work surface 112 in order to provide sufficient distance between the rear edge and upper edge so as to be able to allow passage of a standard power plug. For example, if a lower rear corner 159 of the work surface 112 were extended further rearward to be vertically aligned with an upper rear corner 161, the passageway between the work surface 112 and the tray panel 121 would be reduced, and the entire resource tray 138 would need to be extended downward to compensate. Likewise, if a forward upper corner 163 of the tray panel 121 were extended upward to be horizontally aligned with a rearward upper corner 165, the passageway between the work surface 112 and the tray panel 121 would be reduced, and the entire resource tray 138 would need to be extended downward to compensate. Too low a position for the resource tray 138 may hinder convenient use by rendering, for instance, power receptacles 192 too low to be in the sight line of standing or seated users, forcing them to bend over or climb on the work surface 112 in order to plug in devices.

In at least some circumstances, the illustrated embodiment is also capable of liquid-spill-protection functionality. As shown in FIG. 6A, when the wire cover 114 is in the closed position, the cover seals 113 function to prevent or limit the passage of liquid from the upper side of the work surfaces 112 past the seals 113 and into the resource tray 138. Further, even in circumstances in which an amount of liquid passes underneath a cover seal 113, the corresponding tray seal 119 will tend to direct the passing liquid downward toward the angled upper edge 157, where the angled surface will direct the liquid forward and downward. The liquid will then pass beyond the lower section of the tray seal 119 and onto an exterior side of the lower vertical section 118, rather than into the resource tray 138 and onto receptacles 192, where risk of component damage from the spill as well as potential interruption of work due to electrical short circuits resulting from liquid spills is much greater.

Figure 7:
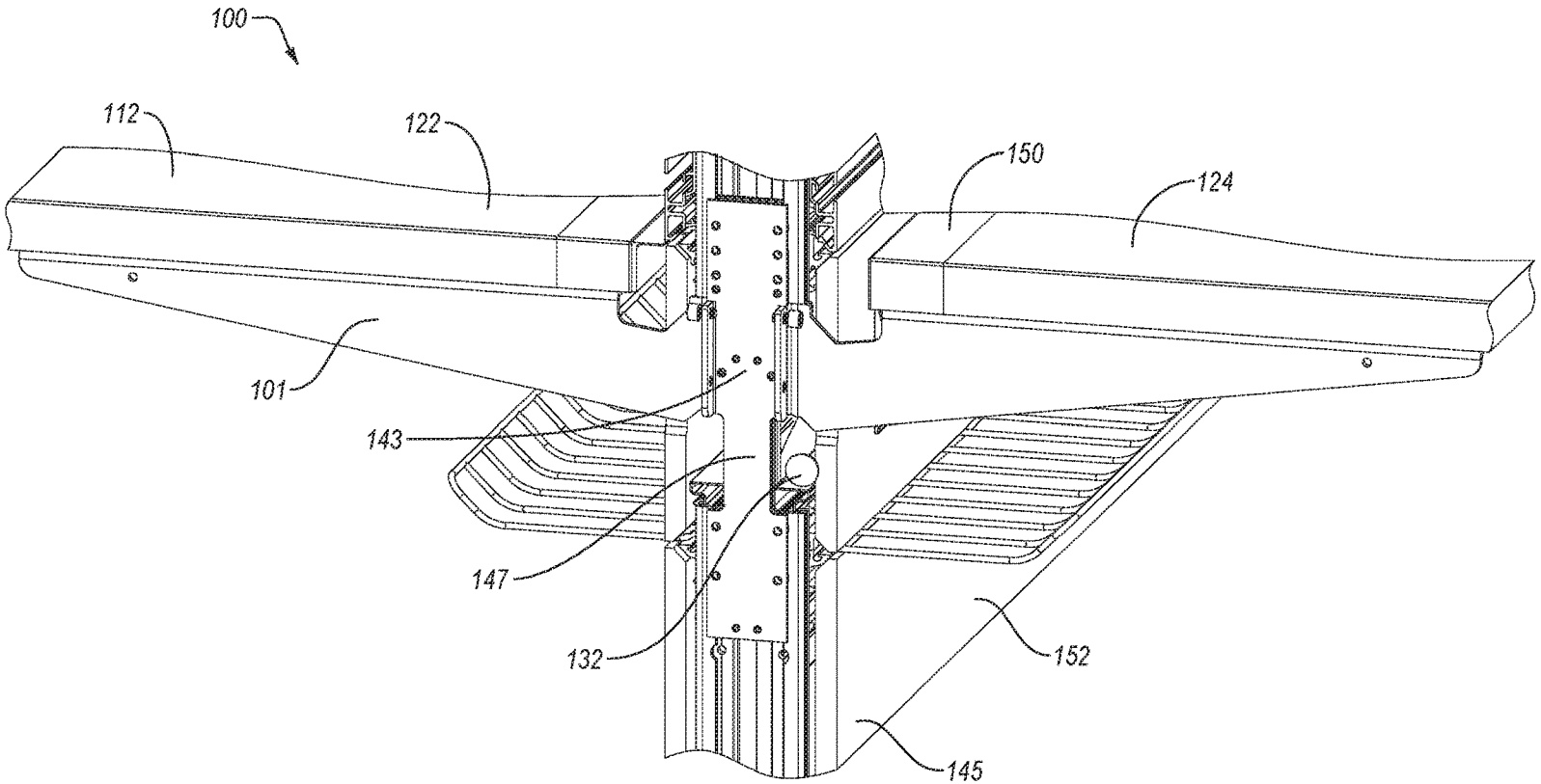
FIG. 7 illustrates a cross-sectional view of the desk system showing a support spline joined to leveling cantilevers and showing construction of the support spline to allow horizontal passage of supply wires around the support spline and cantilevers.

FIG. 7 illustrates a cross-sectional view of a section of the desk system 100 showing exemplary configuration of a support spline 143. As shown, the support spline 143 functions as the mounting structure for attachment of the cantilevers 101, which in turn function as the support structure for the work surfaces 112. Beneficially, attachment of the cantilevers 101 to the support spline 143 enables removal of the access tile 152 without the need for removal of the work surfaces 112, minimizing disturbance to workspaces and/or workers when such access is needed, as opposed to a support member for work surface 112 which may rest against tile 152. The illustrated support spline 143 includes a narrow section 147. When the support spline 143 is positioned within the lower vertical section 145, the narrow section 147 enables horizontal passage of one or more supply wires, such as the illustrated power cable 132, past the support spline 143 to other sections of the desk system 100.

In some embodiments, the lower vertical section 145 and/or other vertical sections described herein have a width (from the first side 122 to the second side 124) of about 3 to 6 inches, or about 4 inches. In some embodiments, the narrow section 147 of a support spline 143 has a width of about 0.75 to about 2 inches, or about 1 inch. For example, the narrow section 147 may have a width that is about 15 to 50% of the width of a corresponding vertical section, or that is about 20-30% or about 25% of the width of the corresponding vertical section.

Figure 8A:
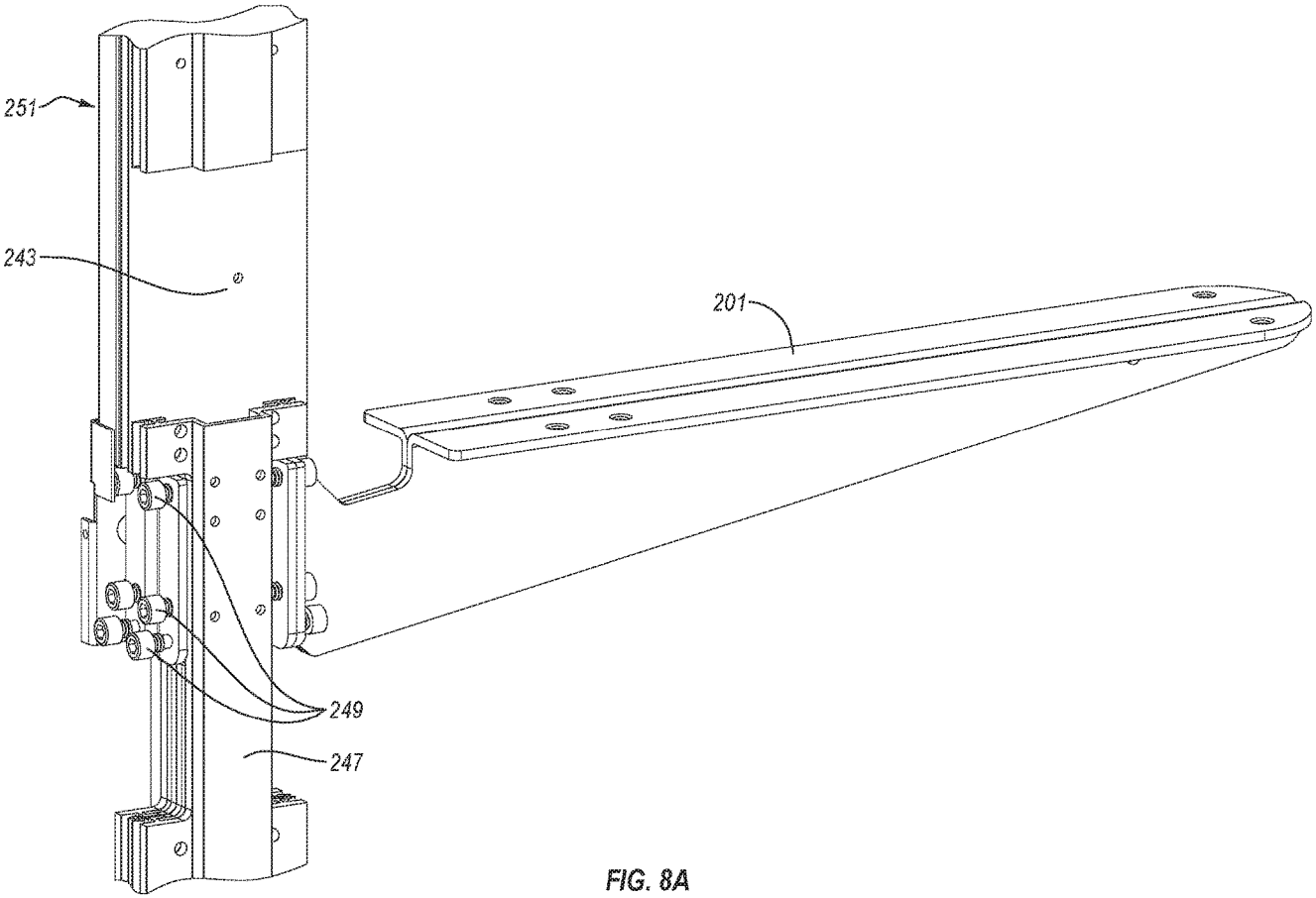
FIGS. 8A and 8B illustrate additional views of a support spline.
Figure 8B:
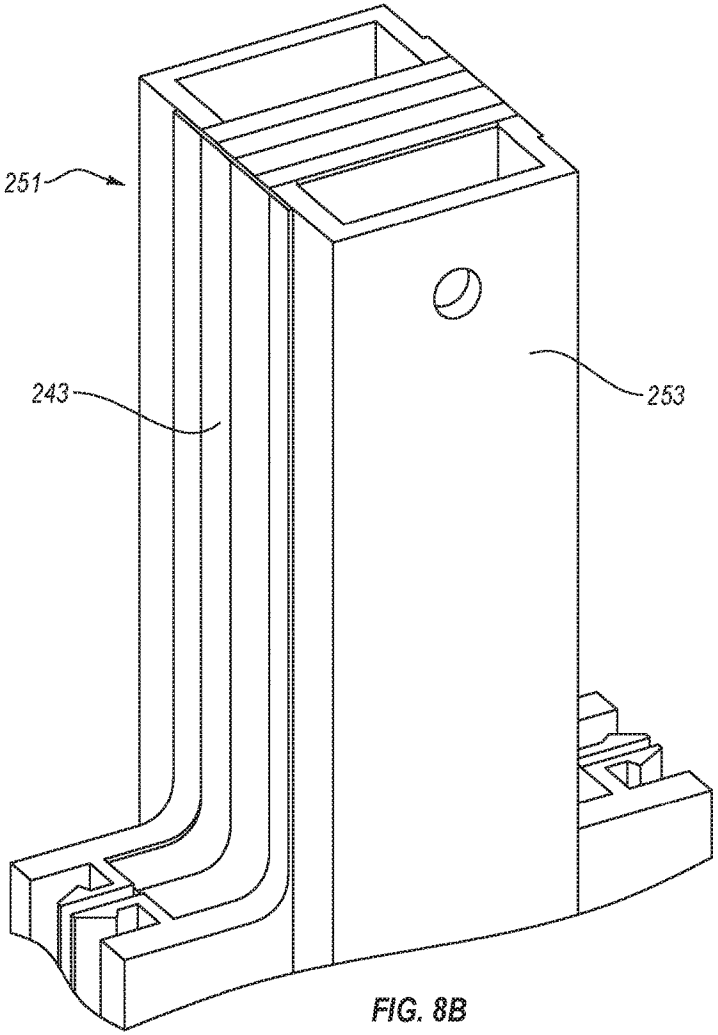

FIGS. 8A and 8B illustrate an exemplary vertical support 251 including a support spline 243. FIG. 8A illustrates an isometric view of the support spline 243 with attached cantilever 201. As shown, the cantilever 201 is attached to the support spline 243 at a plurality of vertically oriented connection points configured to receive fasteners 249 (e.g., screws). The arrangement of multiple fasteners 249 allows the cantilever 201 to be leveled. For example, the cantilever 201 may be hung from the upper fastener 249 to capture cantilever 201 and threadingly engage to the spline 243, then leveled using the bottom connection point fastener 249 to threadingly engage to cantilever 201 to push against spline 243, then secured from lifting using the middle fastener 249 to capture cantilever 201 to threadingly engaged with spline 243.

FIG. 8B illustrates a cross-sectional view of the vertical support 251 showing an interior arrangement making up the support spline 243. In the illustrated embodiment, outer sections 253 of the vertical support 251 are reinforced with one or more solid layers which form the support spline 243. The support spline 243 beneficially provides additional structural integrity to the narrow section 247 of the vertical support 251. In some embodiments, the outer sections 253 are formed of a relatively lightweight material, such as aluminum or a polymer material. In some embodiments, the layers making up the support spline 243 are preferably formed from a relatively high-strength and/or high load-bearing material, such as steel, in order to provide sufficient structural capabilities to the support spline 243.

Figure 9A:
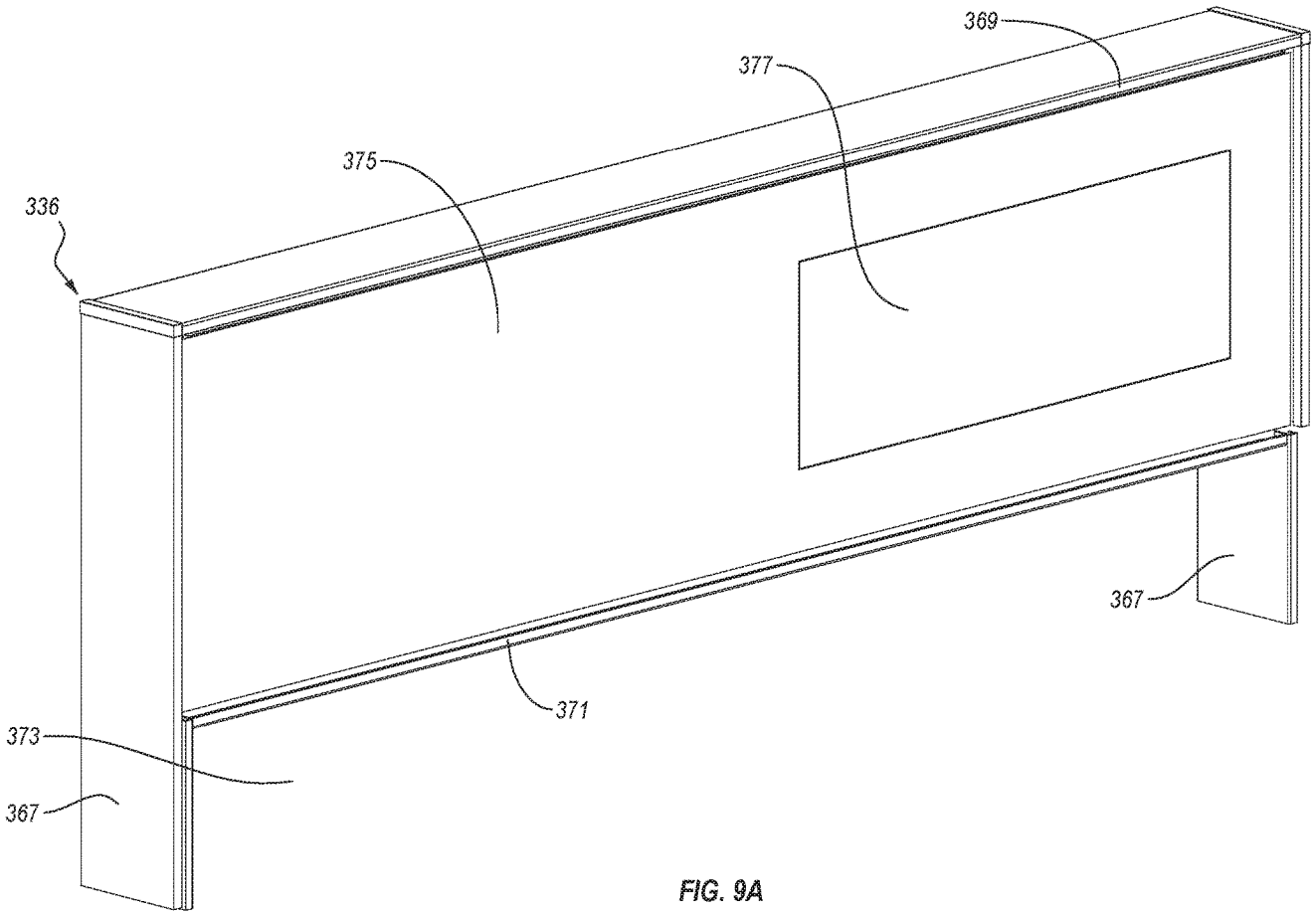
FIGS. 9A and 9B illustrate a monitor system attachable to the desk system.
Figure 9B:
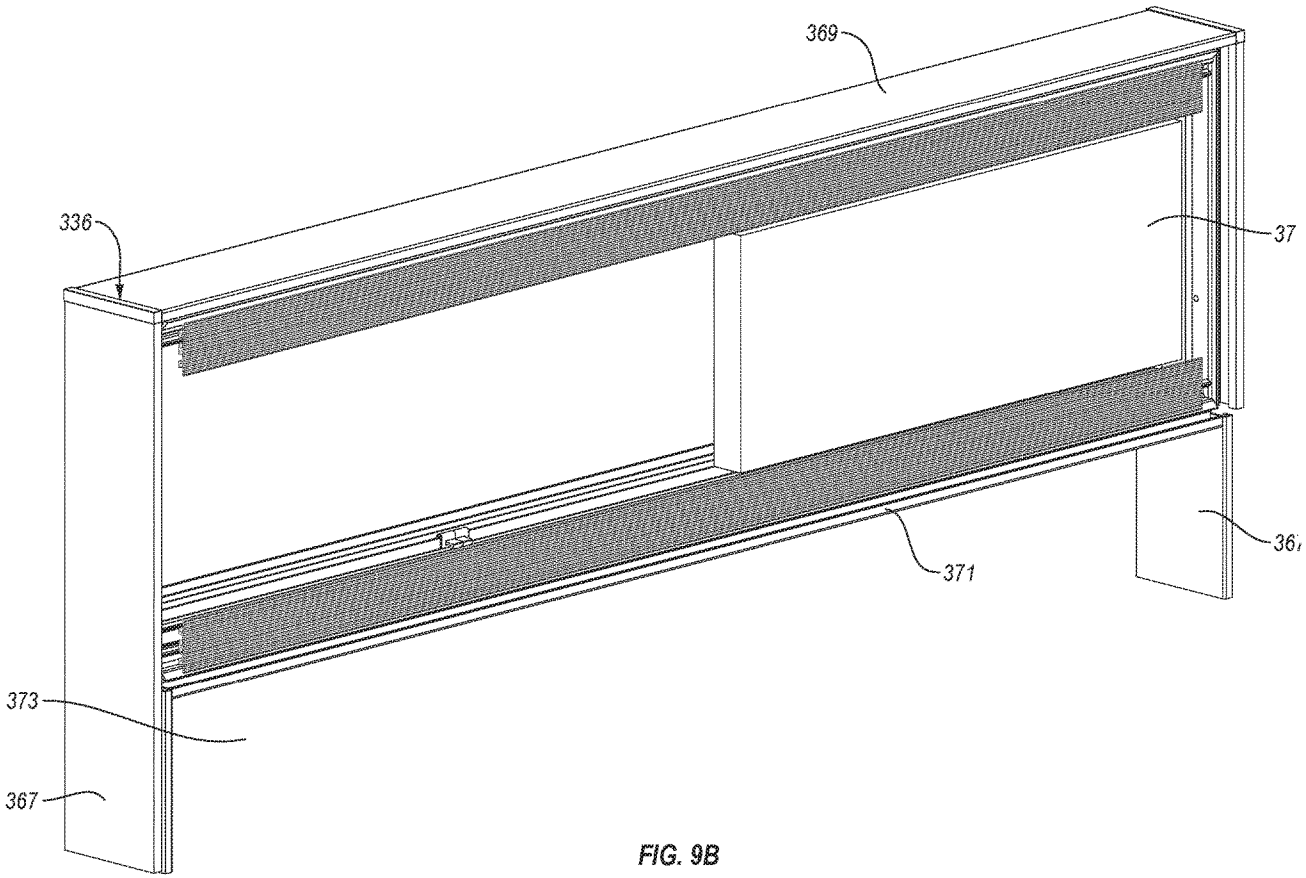

FIGS. 9A and 9B illustrate embodiments of a monitor system 336 which is attachable to one or more of the upper vertical support sections described herein. FIG. 9A illustrates the monitor system 336 showing an outer display surface 375 (e.g., formed of glass). In this embodiment, the monitor 377 is visible through a window formed by back painting the non-window portions of the display surface 375. FIG. 9B illustrates the monitor system 336 with the outer display surface removed to show a monitor 377 mounted within the monitor system 336. Although a single monitor 377 is illustrated in this embodiment, other embodiments include a plurality of monitors, arranged top to bottom and/or side to side to provide a desired overall display arrangement. In some embodiments, one or more monitors may be placed back to back with one or more other monitors, such that one or more monitors are disposed on either side of the monitor system 336.

The illustrated monitor system 336 includes a pair of side supports 367, a top trim 369, and a bottom trim 371. In some embodiments, the top and/or bottom trims 369 and 371 are configured with one or more gaps, slots, holes, or other openings to allow airflow into the interior of the monitor system 336 for cooling of the one or more monitors included within the monitor system 336. For example, in one preferred embodiment, one or more monitors are positioned back to back with one or more other monitors, such that one or more monitors face each direction. The monitors are arranged such that a gap of about 0.5 to 2 inches, or about 0.75 to 1.5 inches, or about 1 inch resides between the back-to-back monitors. Airflow may be beneficially provided through this gap (e.g., driven by one or more fans) to provide necessary cooling of the monitors. The gap additionally or alternatively provides space for electrical wires to move vertically and horizontally to supply the monitors or for other purposes.

The illustrated embodiment also includes an access section 373 disposed below the display surface 375. In the illustrated embodiment, this access section 373 is configured as an open window. In other embodiments, the access section 373 is enclosed, and may be configured with one or more hinged access panels, removable access panels, lockable access panels, slat walls, and other structural features related to vertical sections described herein. In some embodiments, monitor wires, fan wires, data cables, and/or other wires related to the monitor system 336 are passed through the access section 373 from one or more monitors 377 to other components of an upper vertical section to which the monitor system 336 is attached, such as to a resource tray providing desired connections for the monitor wires. In other embodiments, one or more of such components may pass through the side supports 367.

Figure 10A:
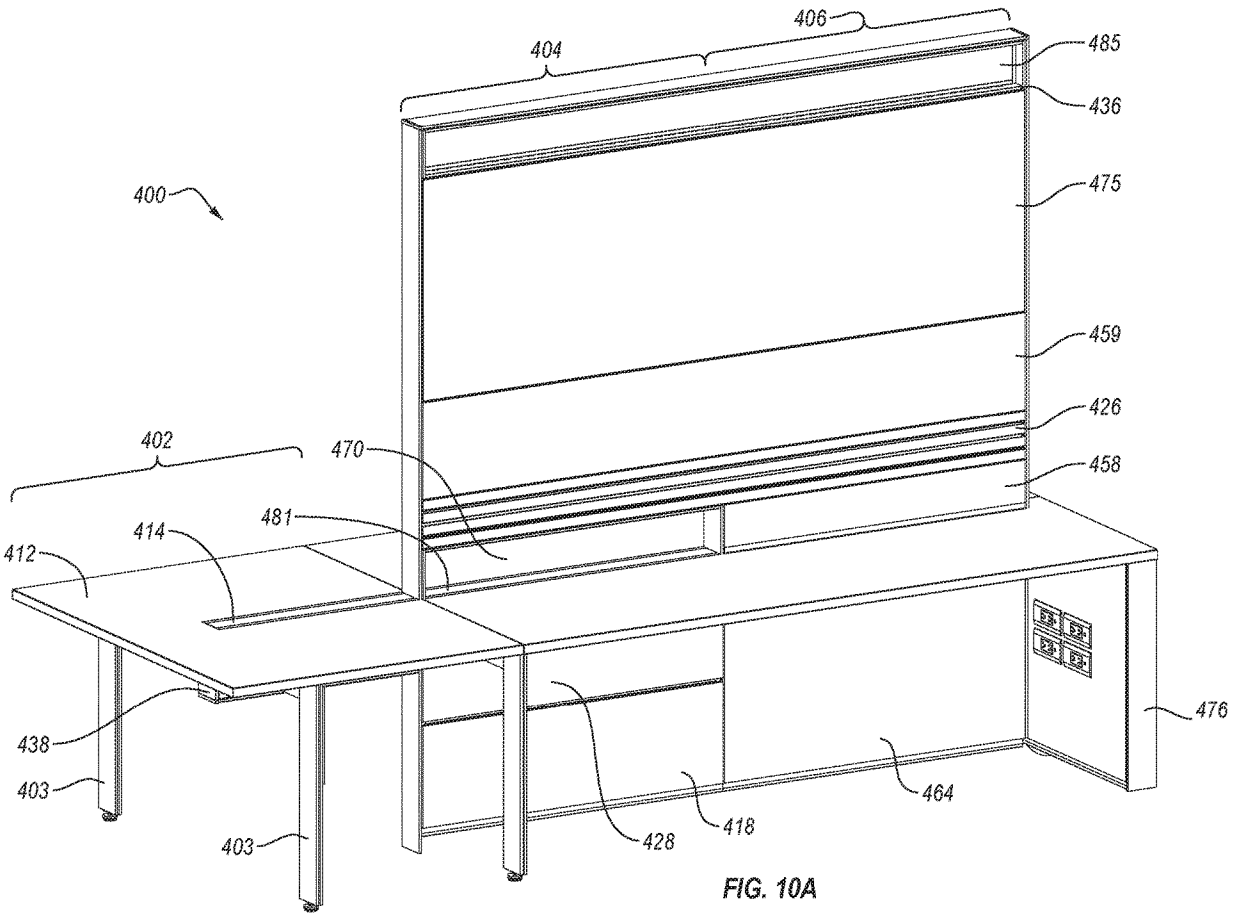
FIGS. 10A-10C illustrate an exemplary modular station suitable for a virtual reality display assembly or other workstation implementation.
Figure 10B:
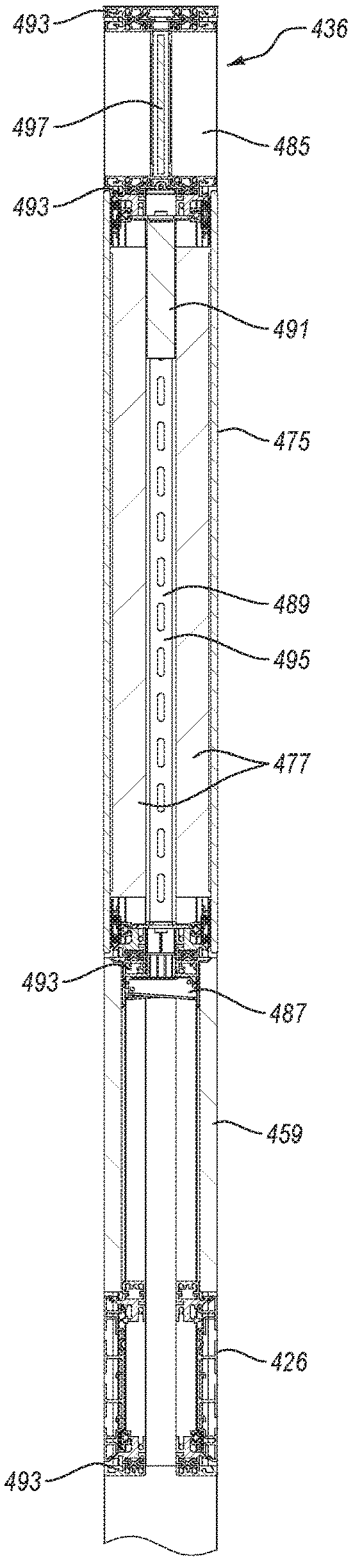
Figure 10C:
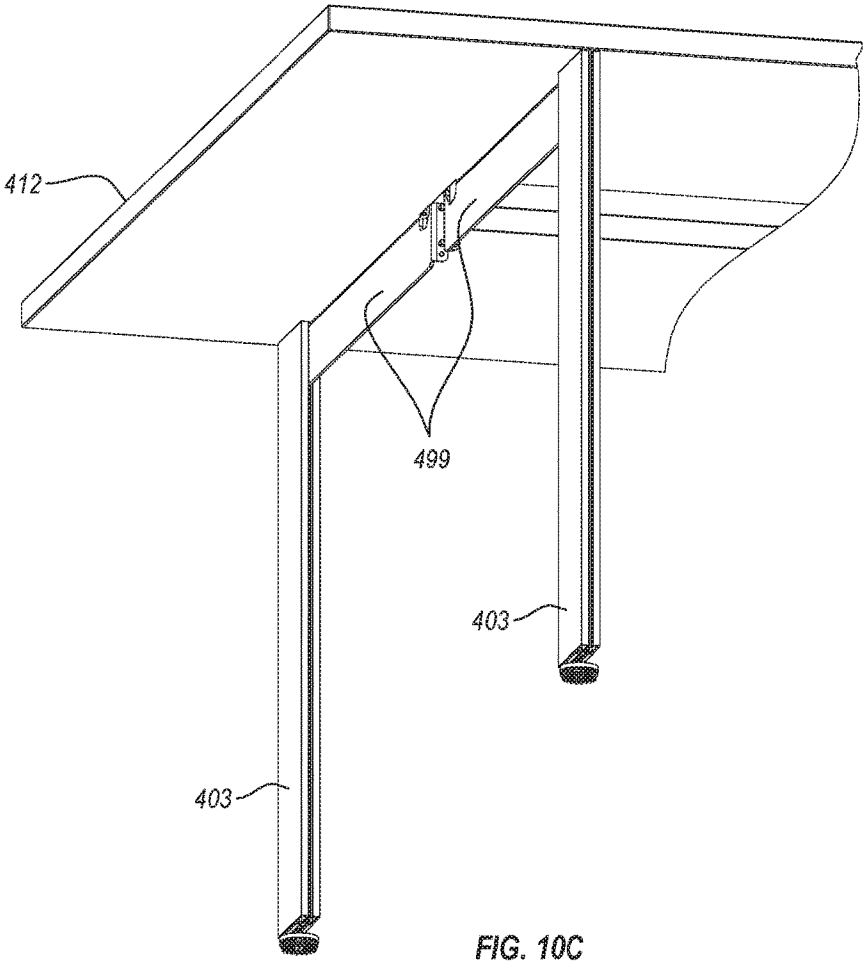

FIGS. 10A-10C illustrate another embodiment of a modular and reconfigurable architectural assembly 400 suitable for use as a workstation, exhibition area, virtual reality display, or other implementation. The embodiment illustrated in FIGS. 10A-10C includes many components and features similar to those shown in one or more of FIGS. 1-9B, and components and/or features of the embodiments described in relation to FIGS. 1-9B may be incorporated into the assembly shown in FIGS. 10A-10C, and vice versa. Further, FIGS. 10A-10C illustrate a particular exemplary arrangement of sections and components. In other embodiments, an architectural assembly may be configured with a different arrangement of sections and/or components. The illustrated architectural assembly 400 is therefore modular and reconfigurable, providing multiple assembly capabilities allowing a user to configure the assembly 400 according to desires and/or particular implementation needs.

As shown in FIG. 10A, the architectural assembly 400 includes a first section 402 having an open-style work surface 412. The first section 402 may be configured similarly to the first section 102 described in detail above. As shown, the first section 402 includes a wire cover 414 which is detachable and/or tiltable to provide access to an underlying resource tray 438, where one or more user wires may be stored, routed, organized, and/or connected to power and/or data connections. The first section 402 also includes a plurality of support legs 403 configured to support the work surface 412. In the illustrated embodiment, the support legs 403 each include an attached cantilever extension allowing each support leg 403 to function as both a horizontal cantilever support and a vertical leg support, as explained in more detail below.

The illustrated assembly 400 also includes a second section 404 and a third section 406, with a monitor system 436 positioned to span the second and third sections 404 and 406. As shown, the second section 404 includes an access window 470 enabling passage of devices or other objects from one side of the assembly 400 to the other. The second section also includes a wire cover 481 which is detachable and/or tiltable to provide access to an underlying resource tray (not shown). The lower vertical section 418 includes a hinged access tile 428 providing another method of access to the resource tray disposed within the lower vertical section 418.

As shown, the third section 406 includes a hinged access cover 458 providing access to a resource tray (not shown). Although not shown in this particular view, the third section 406 may be configured similarly to the third section 106 described above. For example, the third section 406 may include a set of sideways-facing receptacles and wire trays. In this embodiment, an end wall 476 is positioned adjacent to the third section 406. In some embodiments, a vertical corner formed by the end wall and the lower vertical section 464 includes one or more chases for concealing and/or routing one or more user wires, such as user wires from a computer base positioned near the end wall 476 which are routed into the chase and further upwards.

The illustrated embodiment also includes a slat wall 426 spanning across the second and third sections 404 and 406. The slat wall may be configured similarly to other slat walls described herein.

As shown, the monitor system 436 includes an access section 459, a display section 475, and a framing section 485. In this embodiment, the access section 459 is configured to provide hinged access to the interior of the monitor system 436. The interior of the monitor system 436 advantageously includes a gap such that supply wires and/or user wires may be passed from the monitors and other components of the display section 475 to the lower sections of the assembly 400, and vice versa. For example, one or more supply wires or user wires may be passed from a lower section of the assembly through the upper section including the hinged access cover 458, through the slat wall 426, and through the access section 459.

FIG. 10B illustrates a cross-sectional view of the monitor system 436. The illustrated monitor system 436 has a vertically symmetrical configuration, such that components and features referenced on one side may be included on the opposite side as well. For simplicity, some elements of the monitor system 436 will be referenced for one side only. It will be understood that the description applies to the opposite side as well. The illustrated cross-sectional view shows that the display area includes a pair of back-to-back monitors 477. Other embodiments may include other monitor arrangements, with one or more monitors arranged side-to-side and/or one above another, in addition to or alternative to the back-to-back configuration shown. The illustrated embodiment also includes an interior gap 489 defined by the monitors 477 and other components and running between at least the pair of back-to-back monitors 477. One or more support frames 495 may be disposed within the monitor system 436 to provide desired structural support, while preferably being horizontally spaced sufficiently to allow the passage of wires and/or airflow through the interior gap 489.

As shown, one or more fan devices 491 are included so as to provide airflow through the interior gap 489 for cooling the monitors 477. In preferred embodiments, the monitor system 436 has a width of about 3 to 6 inches, or about 4 inches. The interior gap is preferably about 0.5 to 2 inches, or about 1 inch. The illustrated configuration and other similar configurations beneficially provide dual-sided display functionality using a relatively narrow and compact display assembly, while simultaneously maintaining the ability to effectively cool monitors and other components, in addition to managing and organizing associated user and/or supply wires.

The cross-sectional view of FIG. 10B also illustrates the hinges 487 which enable hinged movement of the access section 459. As shown, wires or other components passing through the gap 489 are accessible upon rotating/opening the panel of the access section 459. The slat wall 426 is also shown in this view. As shown, the framing section 485 includes a panel 497. In some embodiments, the panel 497 is a glass panel configured to provide an aesthetic framing arrangement above the display section 475.

FIG. 10B also illustrates various framing elements 493 which are configurable to provide connectivity between one or more different components and/or to provide structural capabilities. As shown, one or more of the framing elements 493 are beneficially configured to maintain the interior gap 489 as it passes vertically through the different sections of the monitor system 436, allowing wires and/or airflow through the interior gap 489.

FIG. 10C illustrates another view of the assembly 400 showing the underside of the work surface 412 of the first section 402. In this view, the cantilever supports 499 of the support legs 403 are visible. As shown, each support leg 403 may be coupled directly to a corresponding cantilever support 499, and each cantilever support 499 may be attached to the underside of the work surface 412 at one or more points.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A modular architectural assembly, comprising:

a substantially horizontal work surface having an upper side and a lower side, the work surface shaped to define at least one opening in the work surface;

a lower vertical section extending a distance below the work surface from the opening of the work surface, the lower vertical section housing a resource tray having one or more power receptacles and data receptacles, wherein the opening provides access to the resource tray within an interior of the lower vertical section and wherein the resource tray is configured to house one or more wires;

an access component configured to enclose the opening of the work surface, the access component being selectively changeable from a closed configuration wherein the opening is partitioned from the work surface to an open configuration wherein the opening is accessible from the work surface; and one or more vertical supports extending through the lower vertical section, wherein:

at least one of the one or more vertical supports includes a support spline having a section of reduced width relative to a width of the at least one vertical support; and the section of reduced width enables one or more supply wires to be moved between the support spline and an access tile.

2. The architectural assembly of claim 1, wherein the access component is a wire cover configured to overlie the opening to form a substantially flat surface across the work surface and the wire cover.

3. The architectural assembly of claim 2, wherein the wire cover includes one or more cover seals extending from a wire cover body to cover one or more edges of the opening, the one or more cover seals being configured to allow passage of one or more user wires from the resource tray to the upper side of the work surface when the wire cover is in the closed configuration.

4. The architectural assembly of claim 2, wherein the lower vertical structure includes a support member for supporting the wire cover in a position substantially flush with the upper side of the work surface when the wire cover is in the closed position.

5. The architectural assembly of claim 4, wherein the support member includes a pivot groove configured with a curved shape to enable a smooth tilting motion as the wire cover is lifted at a first end to move the wire cover from the closed configuration to the open configuration.

6. The architectural assembly of claim 2, wherein the wire cover is detachable from the opening to provide access to the resource tray.

7. The architectural assembly of claim 2, wherein:

the resource tray comprises one or more tray panels that define one or more corresponding side walls; and one or more of a rear edge of the work surface and an upper edge of a corresponding tray panel are angled relative to the work surface.

8. The architectural assembly of claim 7, wherein an upper edge of the tray panel is angled such that fluid spilled on the upper edge will flow away from the one or more receptacles of the resource tray.

9. The architectural assembly of claim 1, wherein the resource tray includes one or more tray seals positioned between the work surface and one or more tray panels.

10. The architectural assembly of claim 9 wherein the one or more tray seals are configured to flex away from the tray panel to provide passage of one or more user wires from the resource tray past the one or more tray seals to an area underneath the work surface.

11. The architectural assembly of claim 1, wherein the lower vertical assembly further includes one or more channels disposed below the resource tray, the one or more channels configured to route one or more supply wires.

12. The architectural assembly of claim 1, further comprising one or more cantilevers attached to the vertical support and extending substantially horizontally from the vertical support to support the work surface.

13. The architectural assembly of claim 1, further comprising an upper vertical section extending above the work surface.

14. The architectural assembly of claim 13, further comprising a hinged access component in the upper vertical section, the access component configured to provide access to the resource tray.

15. The architectural assembly of claim 13, wherein the upper vertical section includes a monitor system housing one or more monitors facing a first direction and one or more monitors facing a second direction.

16. The architectural assembly of claim 1, wherein the resource tray includes one or more wire trays extending perpendicular to the lower vertical section, wherein one or more sideways-facing receptacles are disposed above the one or more wire trays on the lower vertical section.

17. The architectural assembly of claim 1, wherein the lower vertical assembly includes one or more access panels disposed below the work surface, the one or more access panels being openable to provide access to the resource tray.

18. A modular architectural assembly, comprising:

a substantially horizontal work surface having an upper side and a lower side, the work surface shaped to define at least one opening in the work surface;

a lower vertical section extending a distance below the work surface from the opening of the work surface to a position above a floor surface when the architectural assembly is assembled; and a wire cover configured to overlie the opening of the work surface to form a substantially flat surface across the work surface and the wire cover, the wire cover being selectively changeable from a closed configuration wherein the opening is partitioned from the work surface to an open configuration wherein the opening is accessible from the work surface;

wherein:

the lower vertical section houses a resource tray having one or more power receptacles and data receptacles positioned adjacent at least one tray panel;

the lower vertical section comprises one or more removable access tiles that provide access to the resource tray;

the resource tray includes one or more tray seals disposed beneath the work surface;

the opening of the work surface provides access through the work surface to the resource tray within an interior of the lower vertical section; and the resource tray is configured to house one or more user wires extending to the upper or lower side of the work surface.

19. A modular architectural assembly, comprising:

a substantially horizontal work surface having an upper side and a lower side, the work surface shaped to define at least one opening in the work surface;

a lower vertical section extending a distance below the work surface from the opening of the work surface, the lower vertical section housing a resource tray having one or more power receptacles and data receptacles;

wherein: (i) the opening provides access to the resource tray within an interior of the lower vertical section, (ii) the resource tray is configured to house one or more user wires extending to the upper or lower side of the work surface; and (iii) lower vertical assembly includes one or more access panels disposed below the work surface, the one or more access panels being removable to provide access to the resource tray;

an upper vertical section extending a distance above the work surface from the opening of the work surface, the upper vertical section including a monitor system housing one or more monitors mounted on one side of the upper vertical section, and one or more monitors mounted on an opposed second side thereof; and an access component configured to enclose the opening of the work surface, the access component being selectively changeable from a closed configuration wherein the opening is partitioned from the work surface to an open configuration wherein the opening is accessible from the work surface.

20. A modular architectural assembly, comprising:

a substantially horizontal work surface having an upper side and a lower side, the work surface shaped to define at least one opening in the work surface;

a lower vertical section extending a distance below the work surface from the opening of the work surface, the lower vertical section housing a resource tray having one or more power receptacles and data receptacles, wherein the opening provides access to the resource tray within an interior of the lower vertical section and wherein the resource tray is configured to house one or more wires;

a first access component configured to enclose the opening of the work surface, the first access component being selectively changeable from a closed configuration wherein the opening is partitioned from the work surface to an open configuration wherein the opening is accessible from the work surface; an upper vertical section extending a distance above the work surface from the opening of the work surface and a second access component in the upper vertical section, the access component providing hinged access to the resource tray through the upper vertical section.

* * * * *